US007841886B2

(12) United States Patent
Klein

(10) Patent No.: US 7,841,886 B2
(45) Date of Patent: Nov. 30, 2010

(54) CONNECTOR ASSEMBLY

(75) Inventor: Harald Klein, Fuerth (DE)

(73) Assignee: FCI, Versailles (FR)

( * ) Notice: Subject to any disclaimer, the term of this patent is extended or adjusted under 35 U.S.C. 154(b) by 178 days.

(21) Appl. No.: 11/988,317

(22) PCT Filed: Jul. 7, 2005

(86) PCT No.: PCT/EP2005/009172

§ 371 (c)(1),
(2), (4) Date: Jan. 4, 2008

(87) PCT Pub. No.: WO2007/006335

PCT Pub. Date: Jan. 18, 2007

(65) Prior Publication Data

US 2009/0209124 A1 Aug. 20, 2009

(51) Int. Cl.
*H01R 13/627* (2006.01)

(52) U.S. Cl. ..... 439/352

(58) Field of Classification Search ..... 439/544, 439/595, 352; 29/854

See application file for complete search history.

(56) References Cited

U.S. PATENT DOCUMENTS

| | | | | |
|---|---|---|---|---|
| 5,931,688 | A * | 8/1999 | Hasz et al. | 439/247 |
| 6,033,247 | A | 3/2000 | Gregory, II | 439/248 |
| 6,045,410 | A | 4/2000 | Norizuki et al. | 439/701 |
| 6,786,747 | B1 | 9/2004 | Kamath | 439/188 |
| 6,851,973 | B2 | 2/2005 | Bigotta | 439/557 |
| 7,077,696 | B2 * | 7/2006 | Haga et al. | 439/553 |

FOREIGN PATENT DOCUMENTS

| | | |
|---|---|---|
| EP | 0 590 496 A1 | 4/1994 |

* cited by examiner

*Primary Examiner*—Briggitte R Hammond
(74) *Attorney, Agent, or Firm*—Harrington & Smith

(57) ABSTRACT

It is proposed a connection system for connecting a contact receptacle of a connector and a contact header of a counterpart connector. The connection system includes locking means for maintaining the contact receptacle in an intermediate position into a frame of the connector, and unlocking means for releasing the contact receptacle from its intermediate position.

17 Claims, 19 Drawing Sheets

A–A

B–B

C–C

A–A

B–B

C–C

A-A

B-B

C-C

A-A

B-B

C-C

A-A

B-B

C-C

A-A

B-B

C-C

A-A

B-B

C-C

A-A

B-B

C-C

A-A

B-B

C-C

A-A

B-B

C-C

A-A

B-B

C-C

A-A

B-B

C-C

A-A

B-B

C-C

CONNECTOR ASSEMBLY

Figure 1:
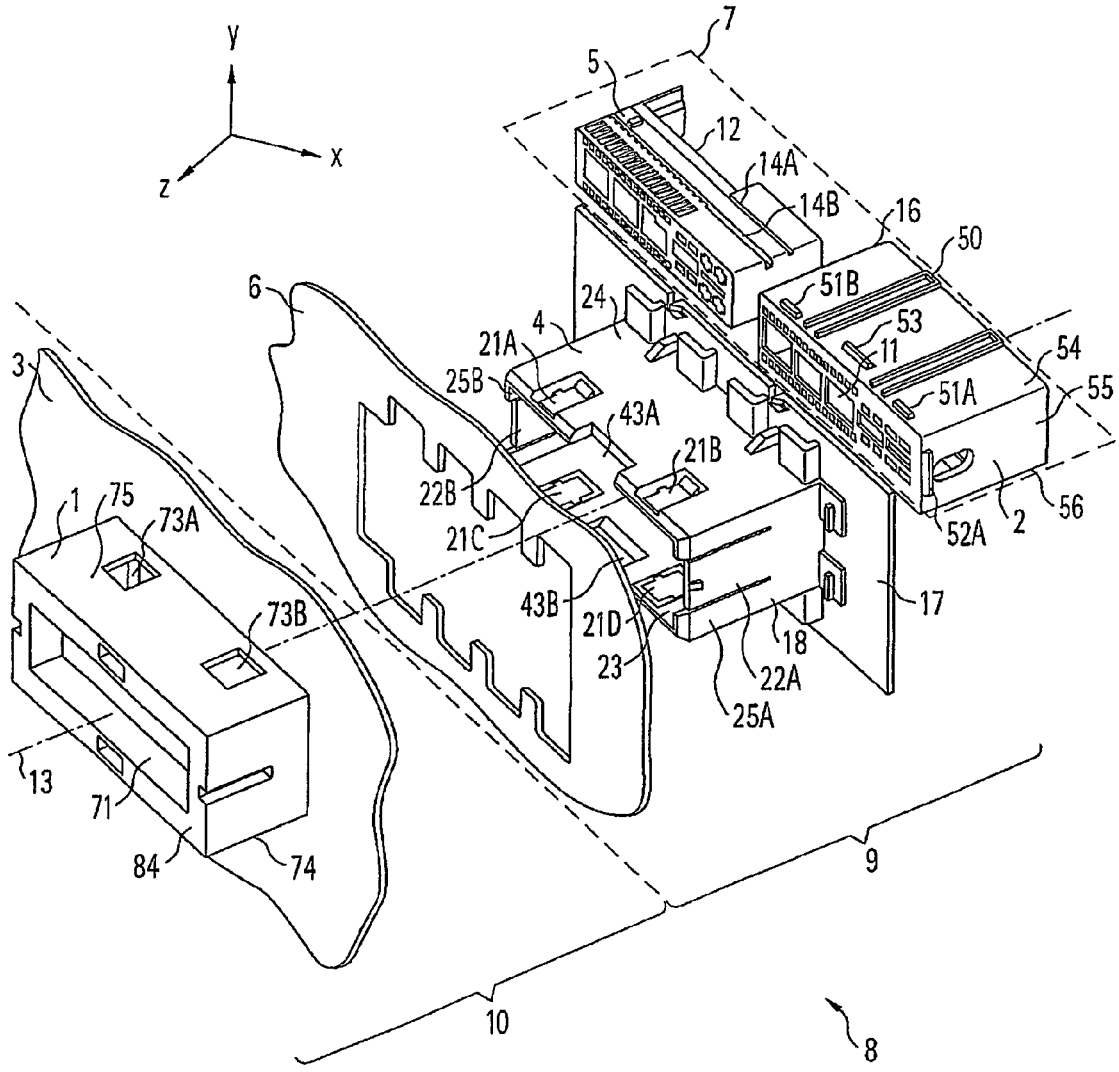

The present invention generally relates to the field of electrical connectors, and particularly to an electrical connector assembly for a contact header and a contact receptacle.

From the state of the art different techniques have been proposed to plug a device into a support frame, and particularly to install an electronic device like a radio in the dashboard of a vehicle.

Conventional mounting processes comprise two separate steps consisting in the electrical connection of the device to the wiring harness of the vehicle and in the mechanical installation of the device casing into the intended opening of the dashboard.

At first, the wiring harness of the vehicle is pulled out of the dashboard opening and connected to the wiring harness of the device. The vehicle harness has therefore to be much longer than what is actually required for the functioning of the installed electronic device, such that an additional space is necessary behind the dashboard to put away the vehicle harness. Moreover, connecting the harnesses can be a tedious operation and improper wire probing can trigger e.g. the airbags in the vehicle.

Then, the device casing is mechanically assembled into a dedicated frame in the vehicle. The separation of these two installation steps therefore demands additional assembly time.

Another known installation method tries to combine the electrical and mechanical connection processes, the force required for the connection being ensured by the compression of a spring. As the connector has to accommodate large tolerances in the plugging direction, the spring is more or less compressed depending on the tolerances.

A disadvantage of this method is that the force of the spring has always to be superior to the connection force. The effort supplied by an operator is therefore equal to the connection force plus an important margin that takes account of the tolerances. The assembly is also difficult because the connection effort has to be maintained until the installation is completed. The conjunction of the spring with the mass of the connector can furthermore create vibrations.

In view of the foregoing, it is an object of the present invention to provide for an improved connector able to compensate for positional tolerances.

According to a first aspect of the invention therefore a method for connecting a contact receptacle of a connector and a contact header of a counterpart connector is proposed. The contact receptacle is thereby locked in an intermediate position into a frame of the connector. Then, the contact header is mated to the contact receptacle. Finally, the contact receptacle is released from its intermediate position into the frame.

Particularly, the plugging of the connector and the counterpart connector can lock the contact receptacle in the intermediate position.

The contact receptacle can be locked to the counterpart connector after the contact header has been mated to the contact receptacle.

Additionally, the mated contact header and contact receptacle are moved within the frame along the plugging axis.

The contact receptacle can be locked in the intermediate position before the connector and the counterpart connector are plugged.

The insertion of the contact receptacle into the frame can thereby lock the contact receptacle in the intermediate position.

The frame can be installed into a support panel in which it can float.

According to another aspect of the invention a connection system for connecting a contact receptacle of a connector and a contact header of a counterpart connector is proposed. The system comprises locking means for maintaining the contact receptacle in an intermediate position into a frame of the connector, and unlocking means for releasing the contact receptacle from its intermediate position.

The locking means can be adapted to lock the contact receptacle in the intermediate position during the plugging of the connector and the counterpart connector.

The system can furthermore comprise locking means for locking the contact receptacle to the counterpart connector after the contact header has been mated to the contact receptacle.

The locking means can be adapted to lock the contact receptacle to the counterpart connector after the contact header has been mated to the contact receptacle.

A free space can be designed for the mated contact header and contact receptacle to be moved within the frame along the plugging axis.

The system can comprise locking means for maintaining the intermediate position of the contact receptacle before the connector and the counterpart connector are plugged.

The system can also comprise a support panel for installing the frame, the frame being able to move along the support panel.

According to another aspect of the invention a connector for plugging in a counterpart connector is proposed, the connector comprising a frame and a contact receptacle that is movable into the frame. First locking means of the frame and/or first locking means of the contact receptacle are designed to lock the contact receptacle in an intermediate position into the frame, and second locking means of the contact receptacle are designed to lock the contact receptacle to the counterpart connector.

According to still another aspect of the invention a counterpart connector for plugging in a connector is proposed. The counterpart has a contact header, which comprises means for unlocking the contact receptacle of the connector from an intermediate position into the frame, and locking means for locking of with the contact receptacle of the connector.

According to still another aspect of the invention an electronic device comprising at least one counterpart connector as previously defined is proposed.

Figure 2A:
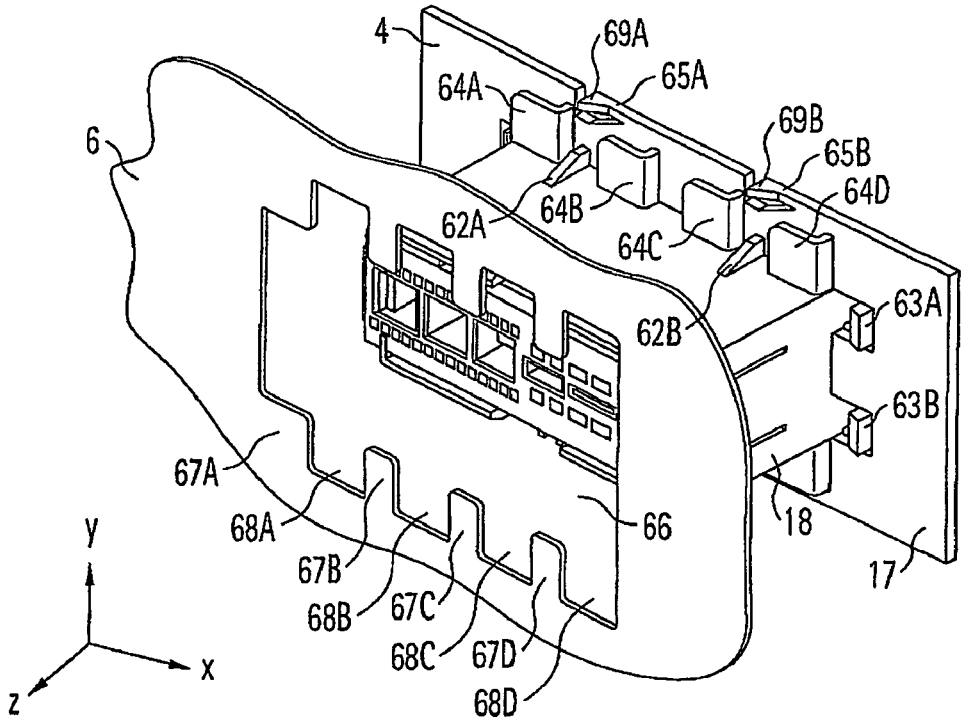
Figure 2B:
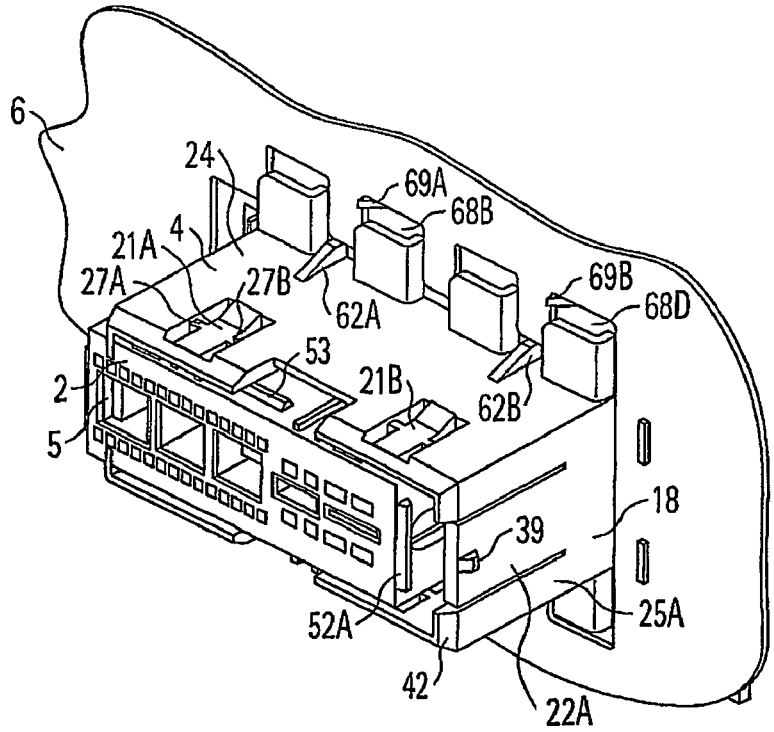
Figure 2C:
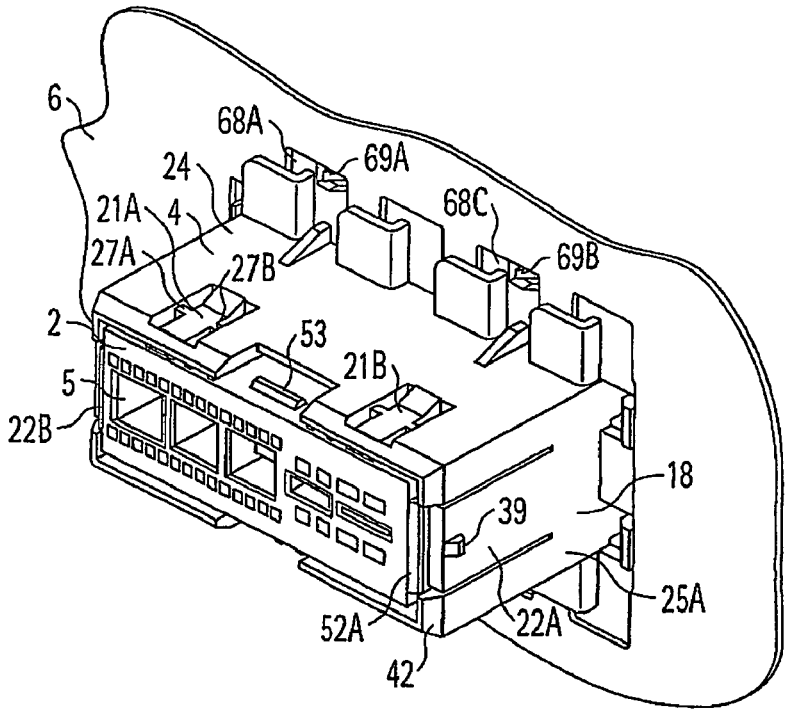
Figure 3:
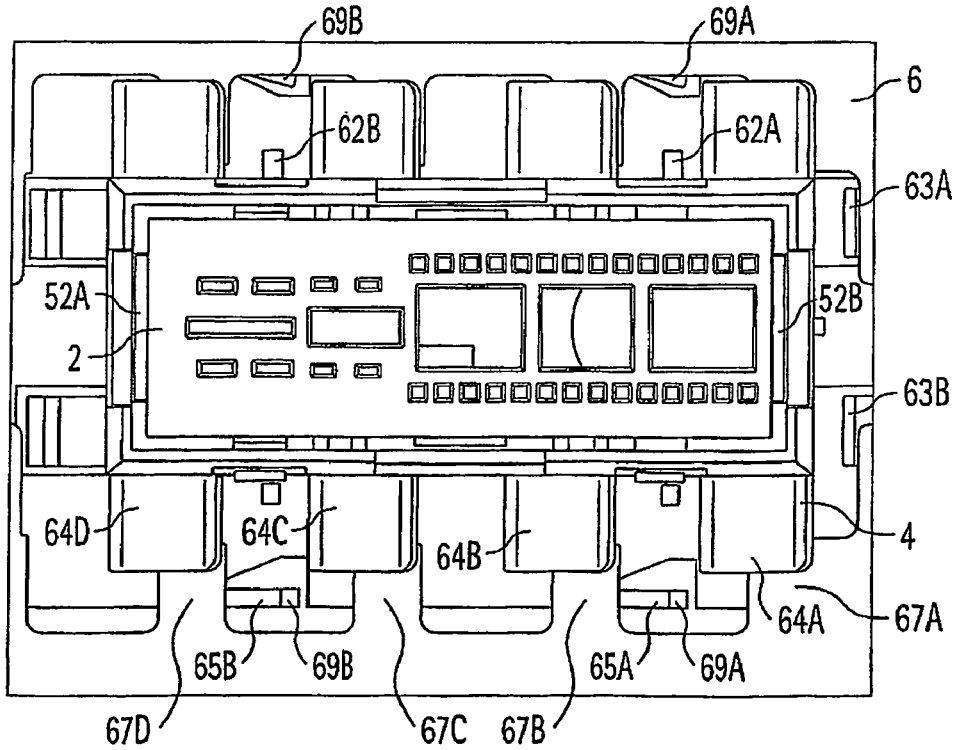
Figure 4:
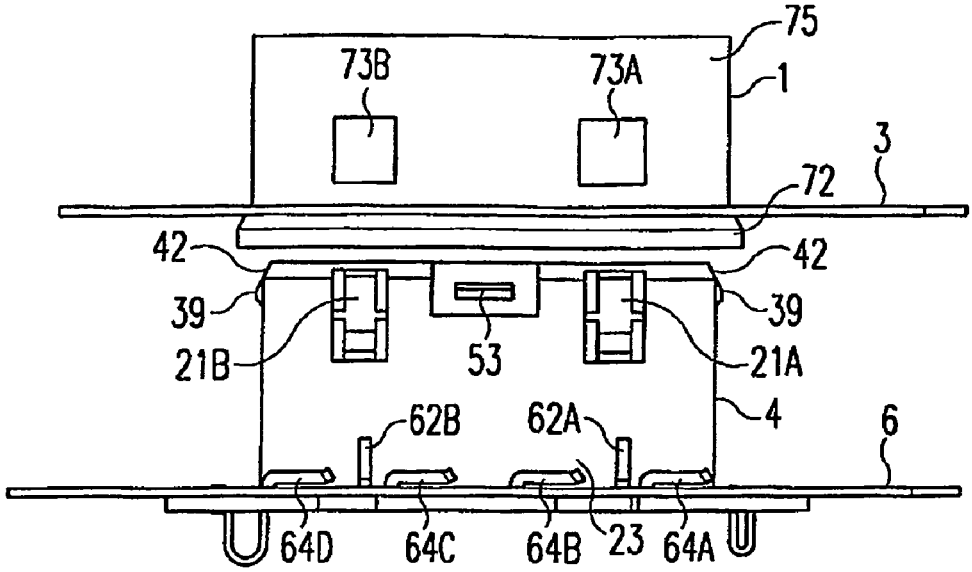
Figure 5:
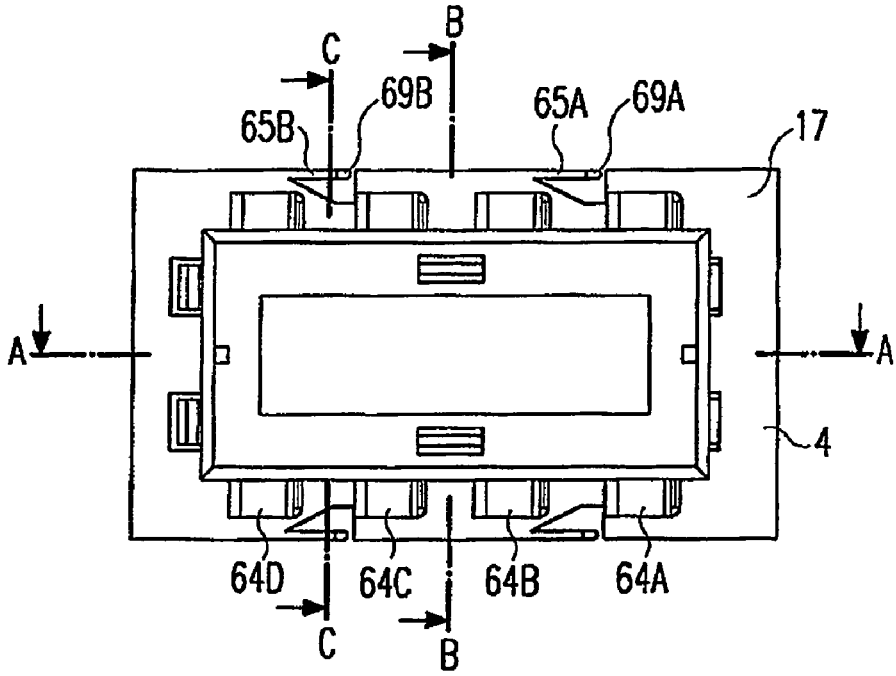
Figure 6:
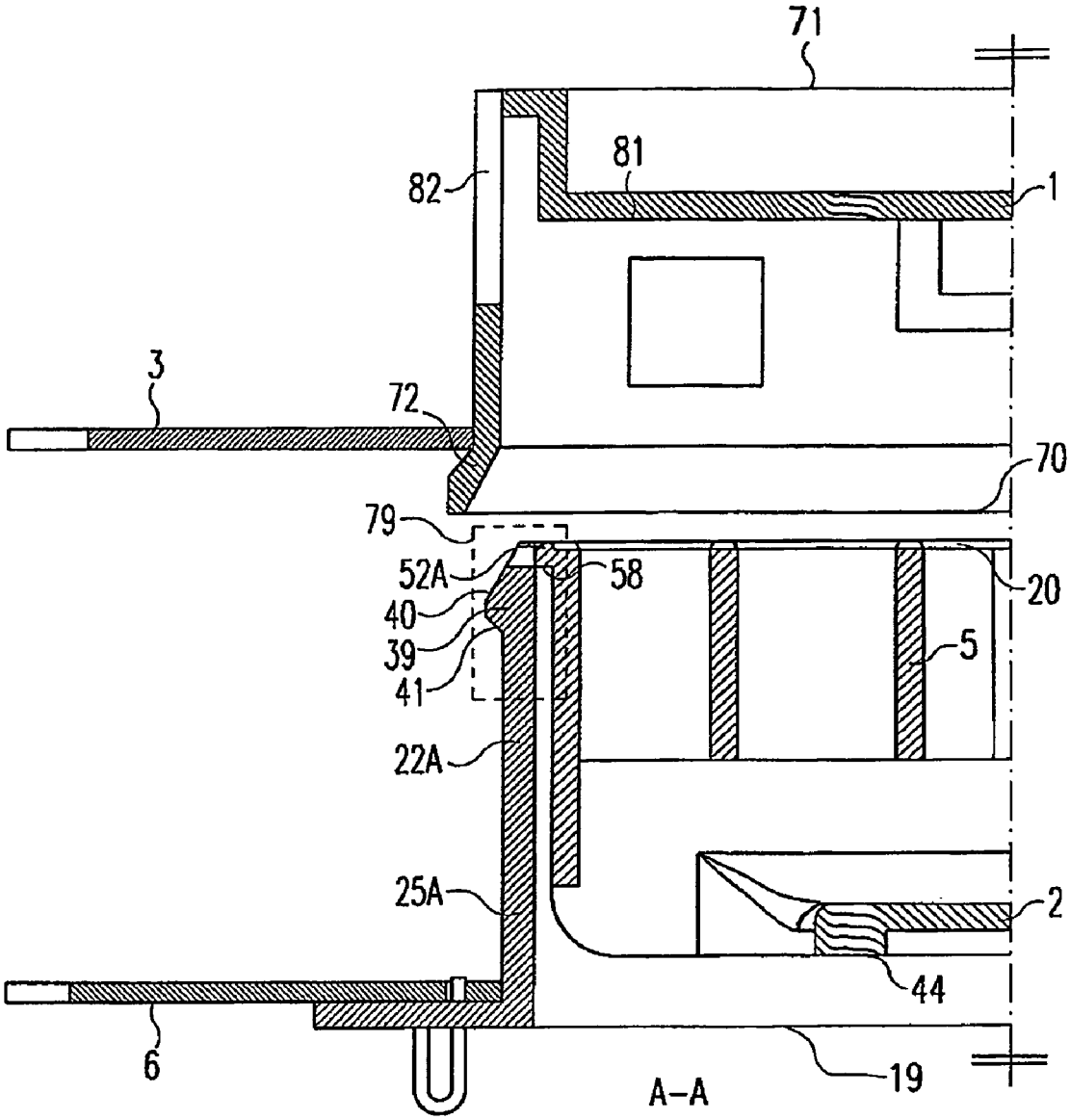
Figure 7:
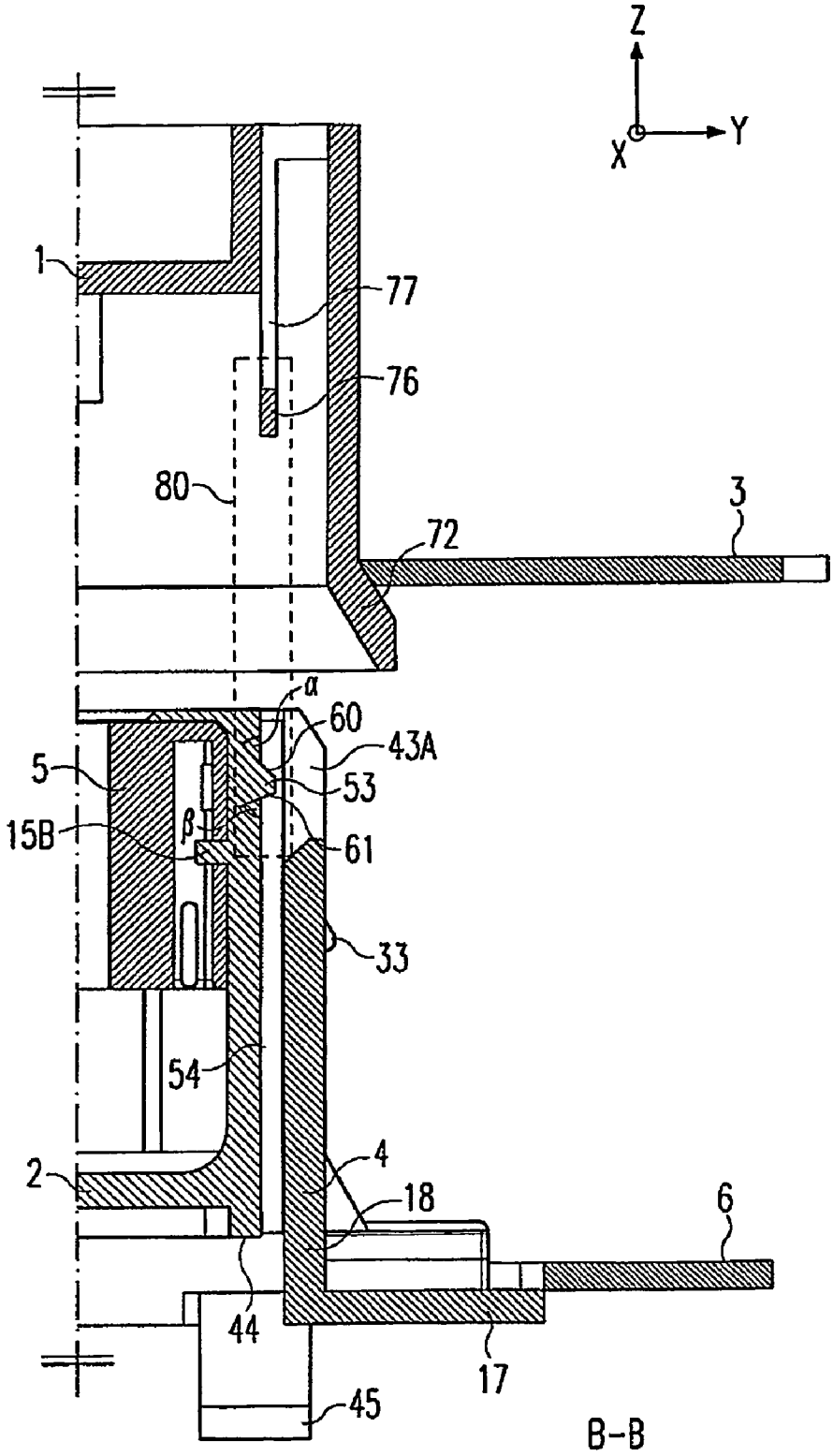
Figure 8:
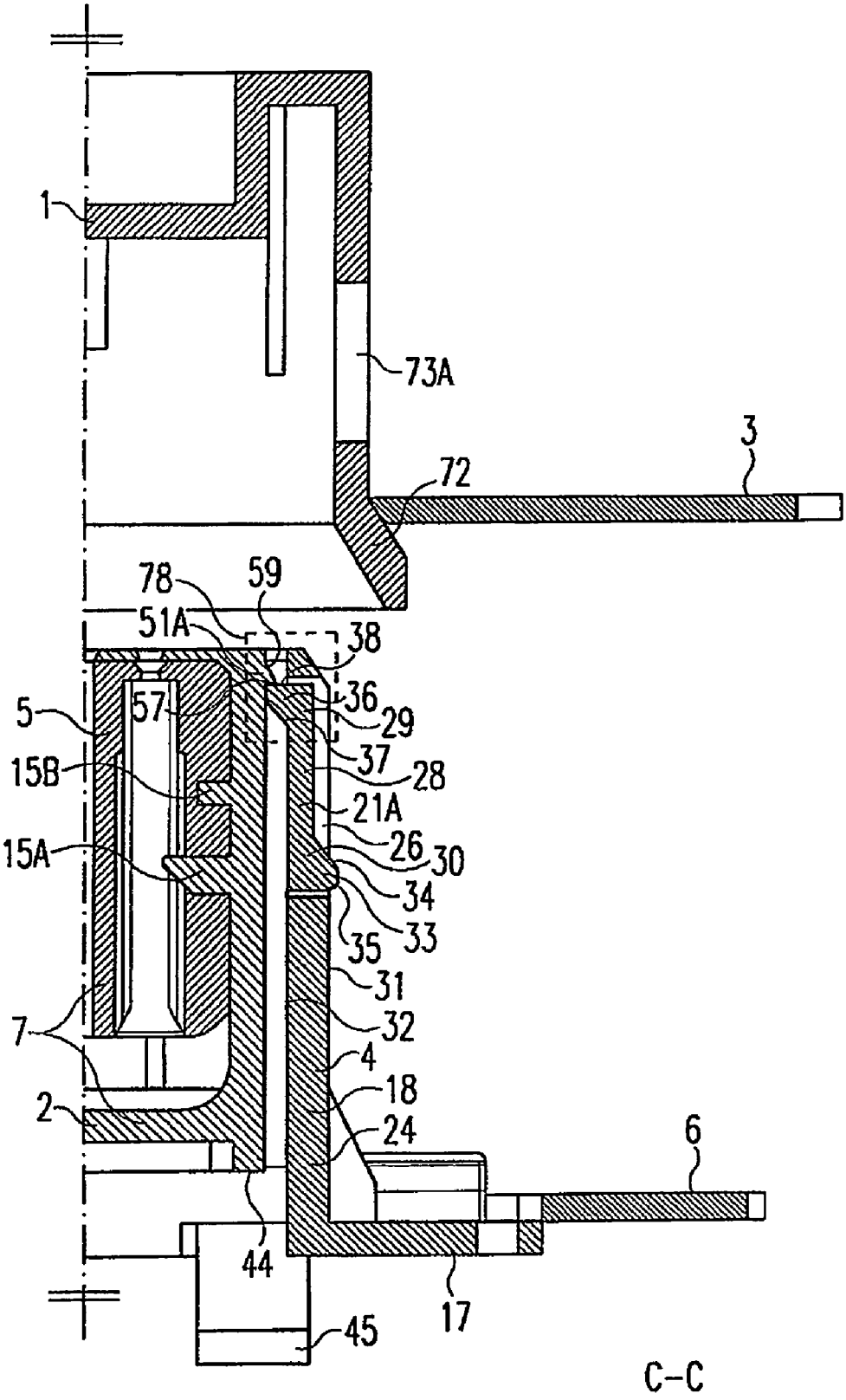
Figure 13A:
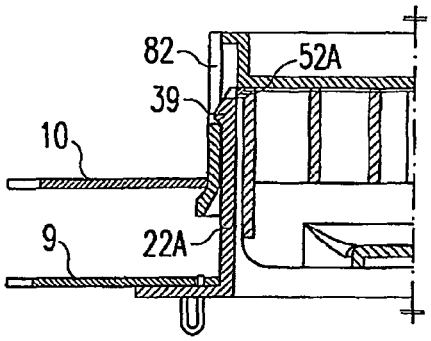
Figure 13B:
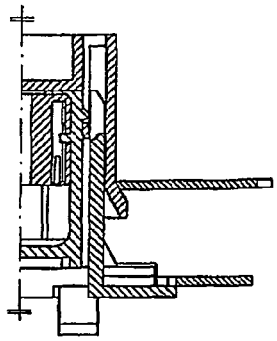
Figure 13C:
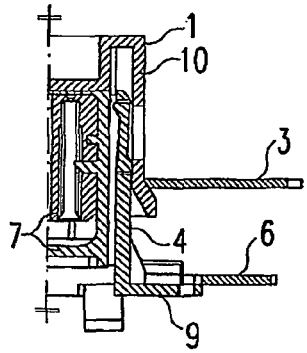
Figure 14A:
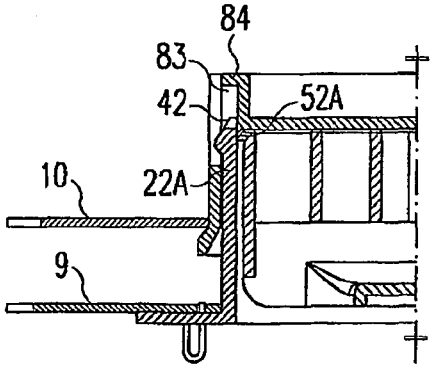
Figure 14B:
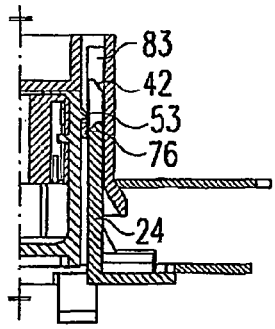
Figure 14C:
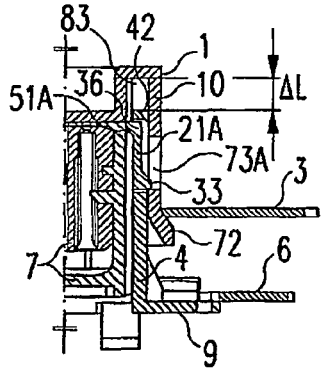
Figure 15:
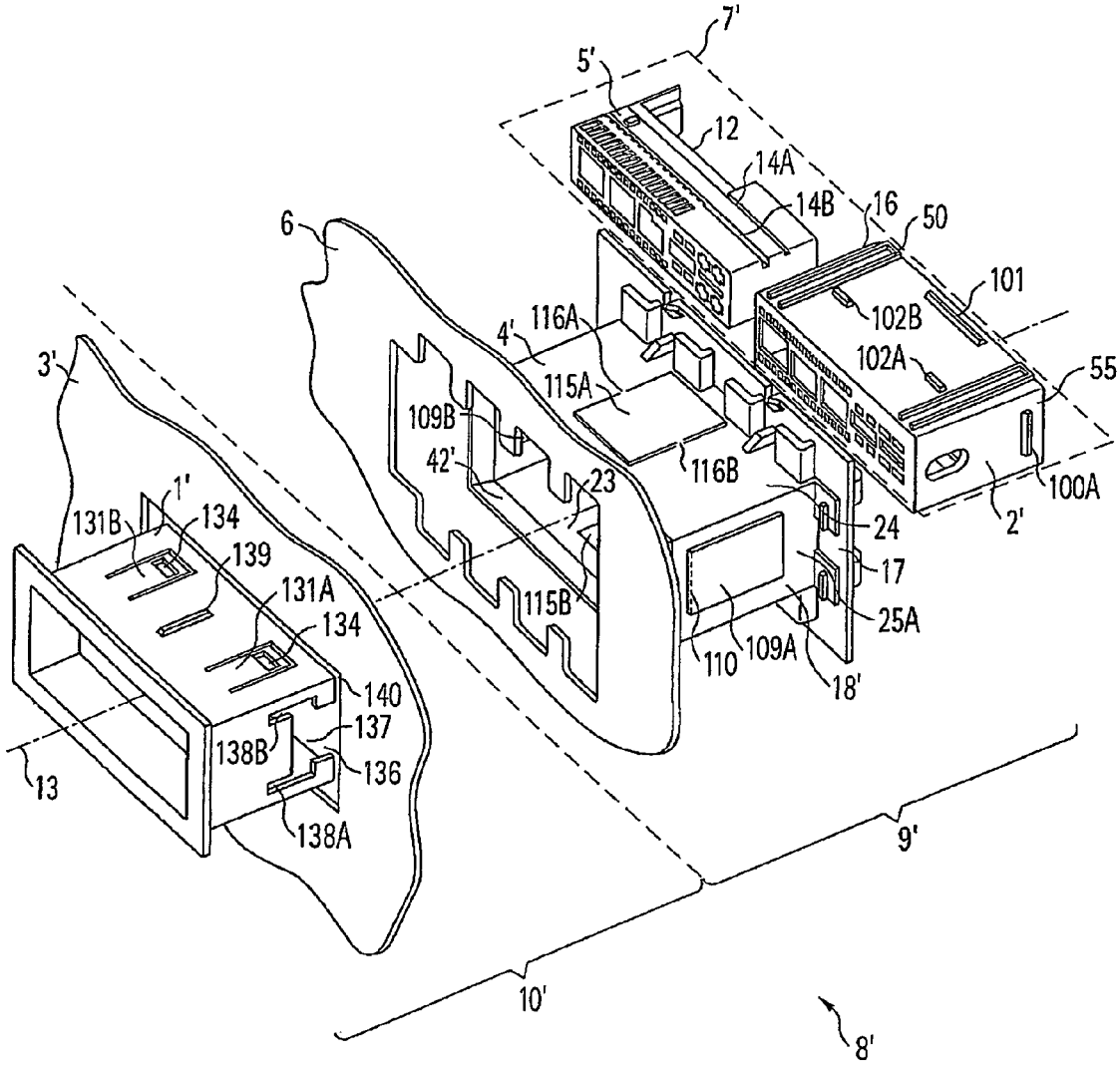
Figure 16:
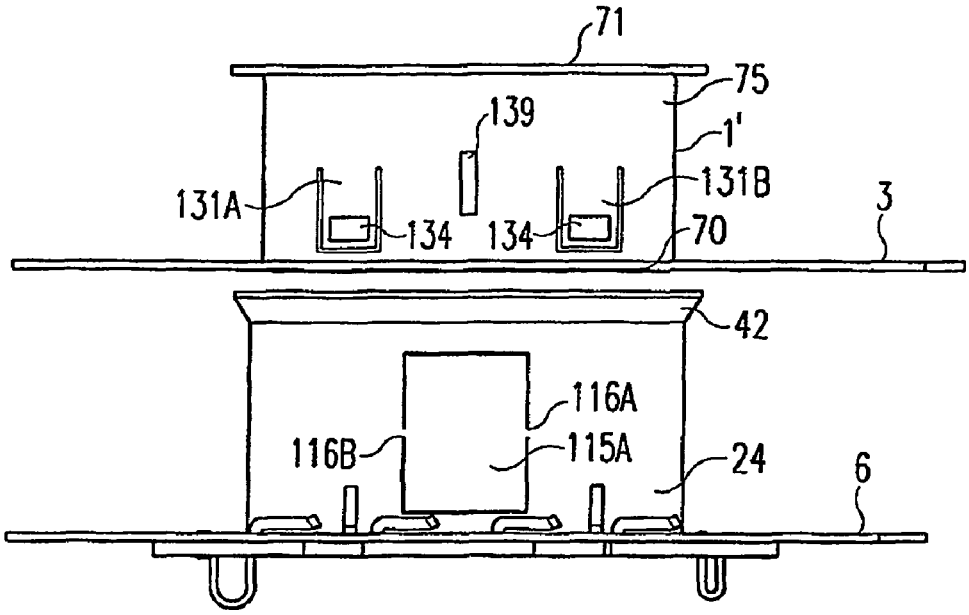
Figure 17:
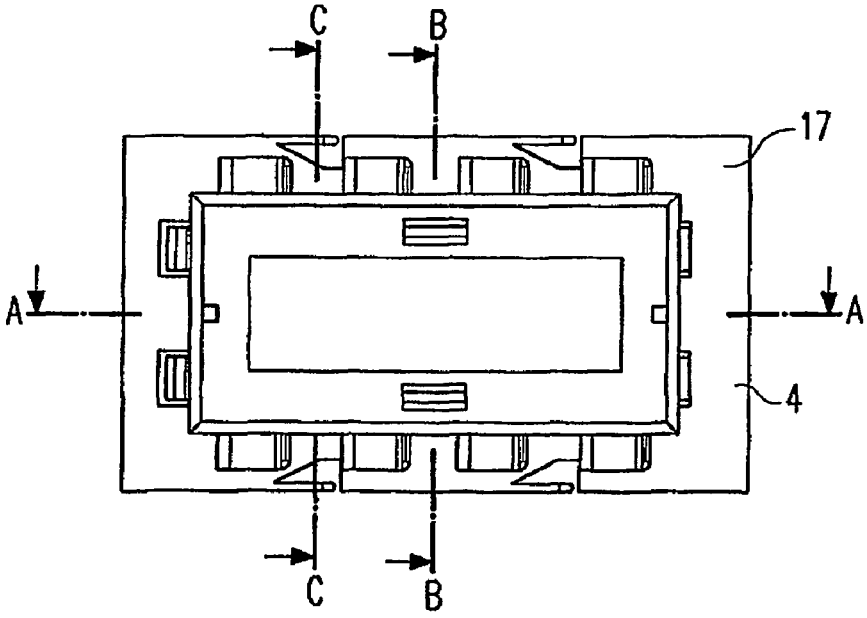
Figure 18:
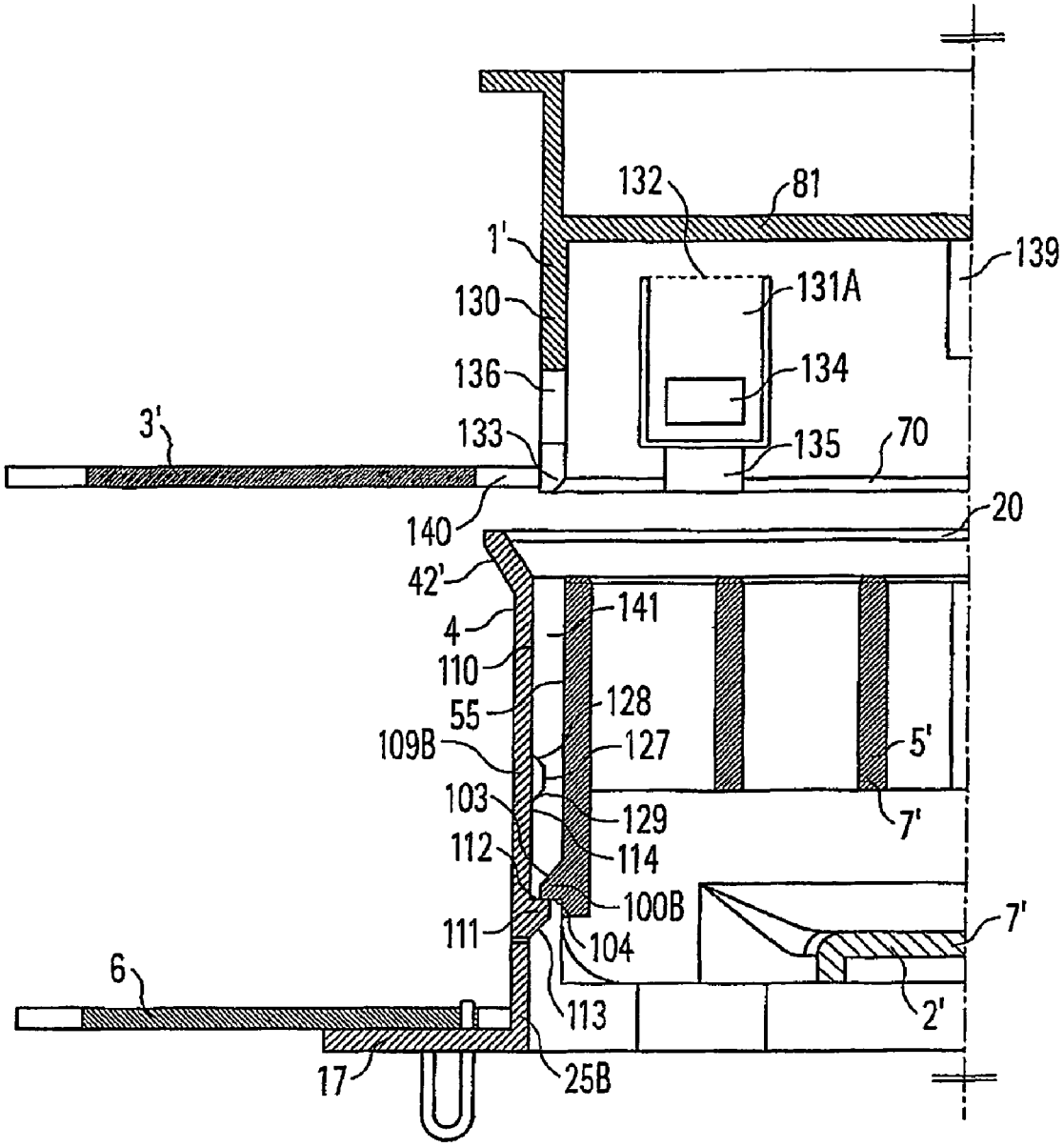
Figure 19:
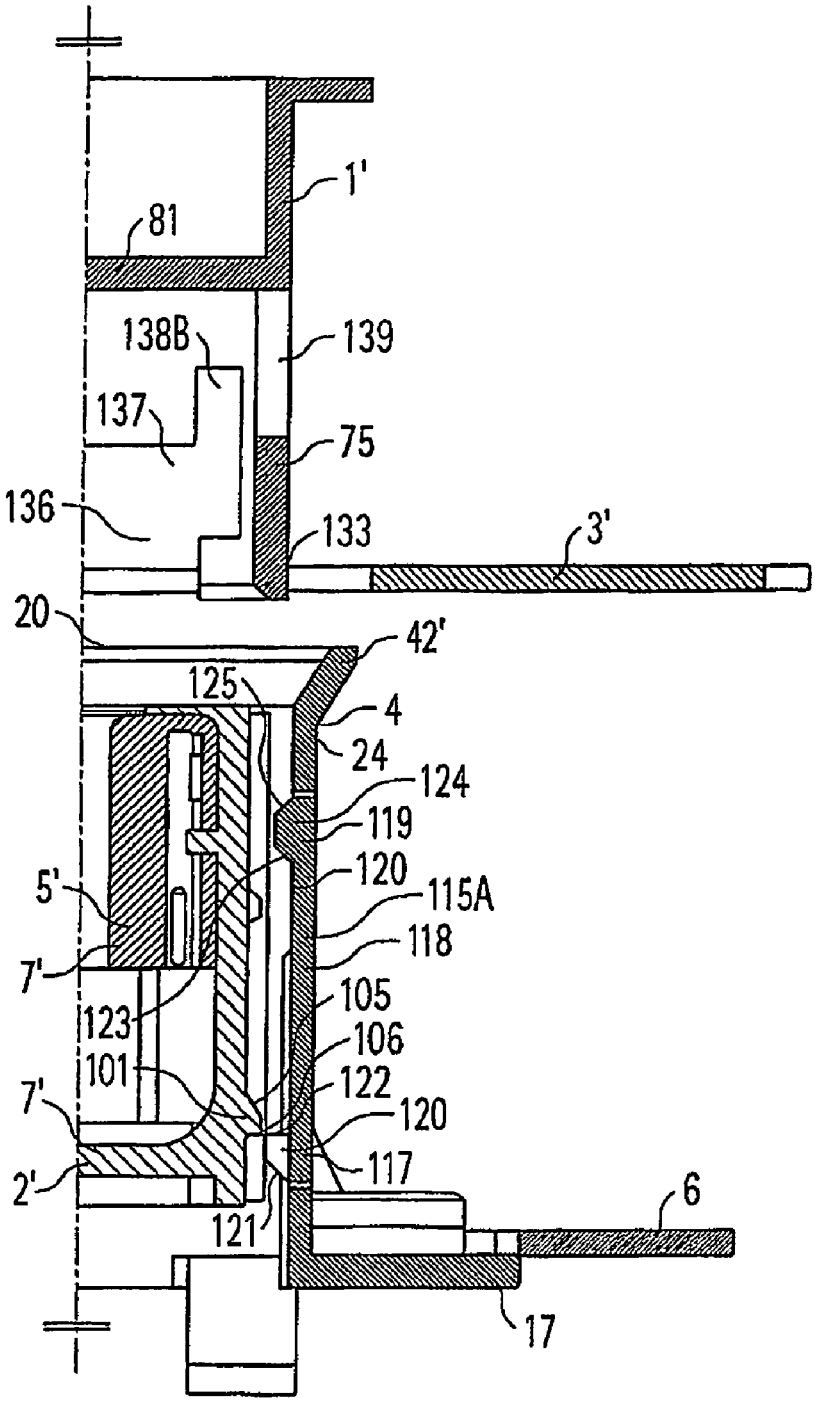
Figure 20:
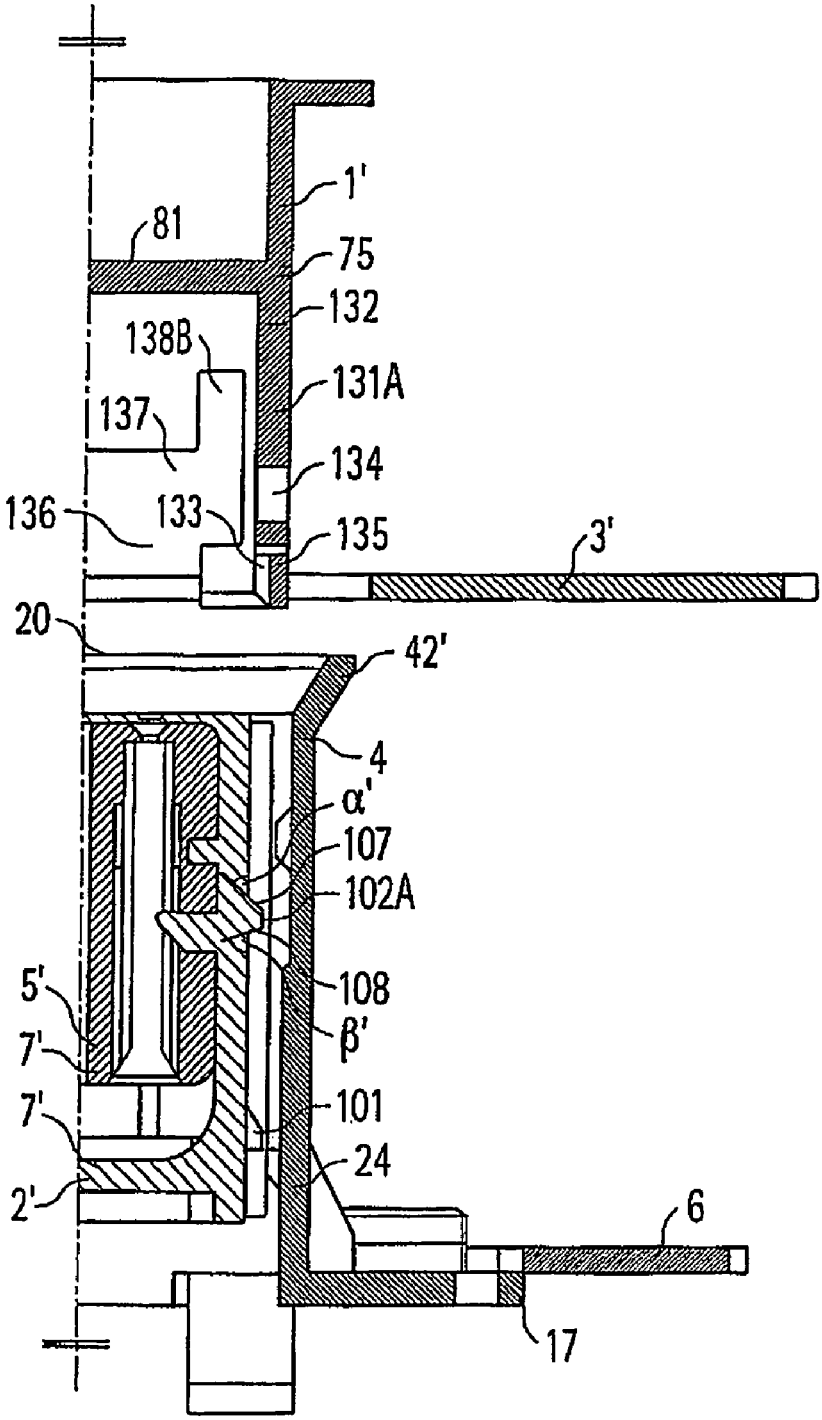
Figure 25A:
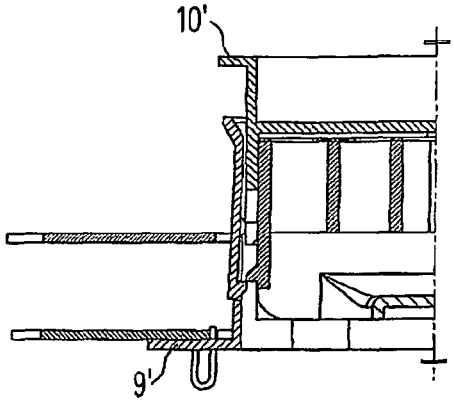
Figure 25B:
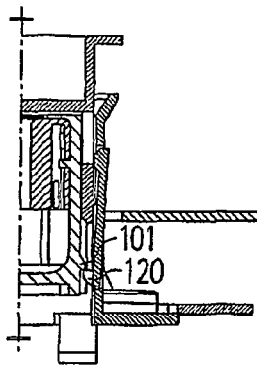
Figure 25C:
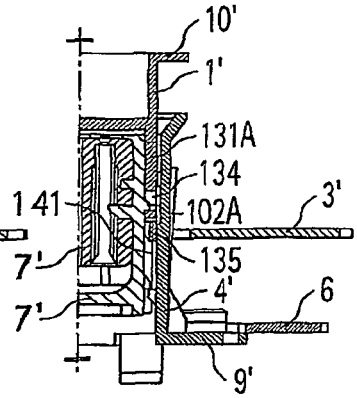
Figure 26A:
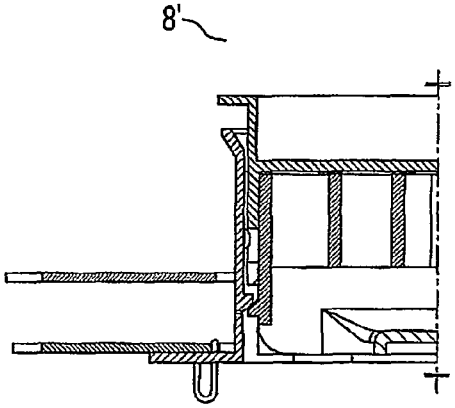
Figure 26B:
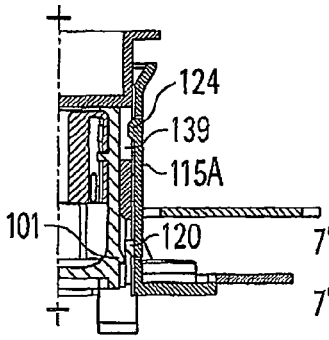
Figure 26C:
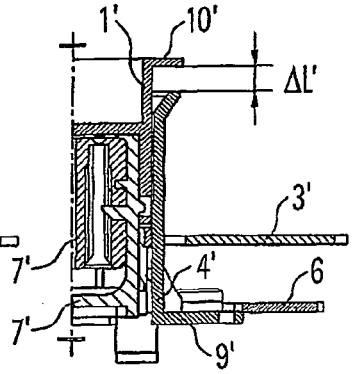
Figure 27:
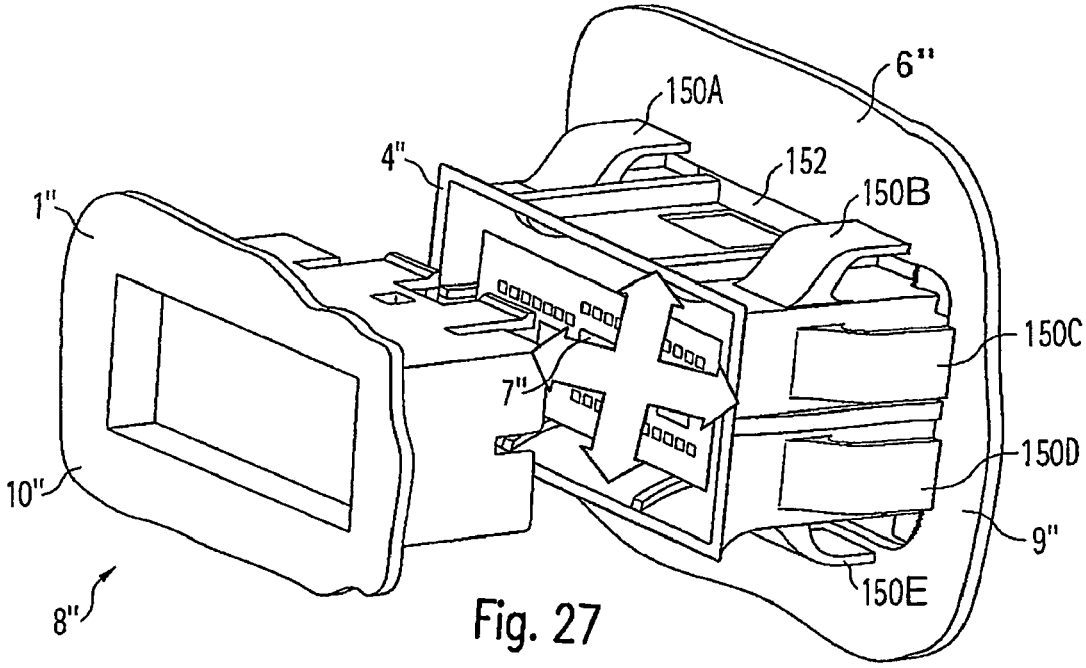
Figure 28:
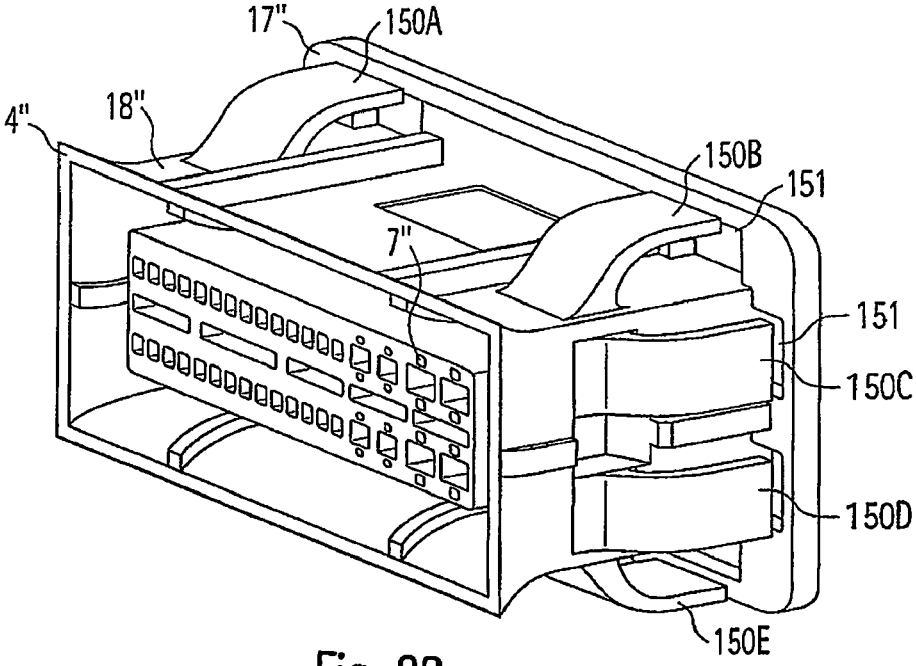

Additional aspects and features of the present invention will come clear from the following detailed description of preferred embodiments and by referencing to the figures of the accompanying drawings, in which:

FIG. 1 shows an exploded representation of the electrical connector system comprising a connector and its counterpart according to a first embodiment of the invention, FIG. 2A to 2C show the different phases of the mounting of the connector according to the first embodiment of the invention, FIG. 3 shows a front view of the mounted connector according the first embodiment of the invention, FIG. 4 shows the first embodiment of the electrical connector in the unplugged state, FIG. 5 shows a front view of the connector according to the first embodiment, FIG. 6 is a cross-sectional view taken along the line A-A of FIG. 5, FIG. 7 is a cross-sectional view taken along the line B-B of FIG. 5, FIG. 8 is a cross-sectional view taken along the line C-C of FIG. 5, FIGS. 9 to 14 show the electrical connector according to the first embodiment of the invention during the plugging of the connector and its counterpart, wherein the views are cross-sections taken along the lines A-A, B-B, and C-C of FIG. 5, FIG. 15 shows an exploded representation of the electrical connector system comprising a connector and its counterpart according to a second embodiment of the invention, FIG. 16 shows the second embodiment of the electrical connector in the unplugged state, FIG. 17 shows a front view of the connector according to the second embodiment, FIG. 18 is a cross-sectional view taken along the line A-A of FIG. 17, FIG. 19 is a cross-sectional view taken along the line B-B of FIG. 17, FIG. 20 is a cross-sectional view taken along the line C-C of FIG. 17, FIGS. 21 to 26 show the electrical connector according to the second embodiment of the invention during the plugging of the connector and its counterpart, wherein the views are cross-sections taken along the lines A-A, B-B, and C-C of FIG. 17, FIG. 27 shows an electrical connector system comprising a connector and its counterpart according to a third embodiment of the invention, and FIG. 28 shows the connector according to the third embodiment of the present invention.

In the following a first embodiment of the connection system according to the present invention will be described with reference to FIGS. 1 to 8.

FIG. 1 shows an exploded representation of the first embodiment of a connection system 8 according to the invention. The first part of the connection system 8 is an electrical connector 9 comprising a contact receptacle 7 being placed into a frame 4. The frame 4 is mounted into a support panel 6 that can be part of e.g. the dashboard of a vehicle.

The second part of the connection system 8 is an electrical counterpart connector 10 comprising a contact header 1 that is rigidly fixed to a casing 3, in which an electronic device can be inserted. The electrical connector 9 and its counterpart 10 are connected together along a plugging axis 13.

FIGS. 1 to 8 describe the different elements of the electric connector 9 and its counterpart connector 10. The contact receptacle 7 of the electrical connector 9 preferably has a parallelepipedic shape, and has a front opening 11 for receiving the mating counterpart connector 10, and a rear opening 12 for receiving electrical elements, not depicted in the figures, that can take the form of a wiring harness, i.e. in the form of electric wires. Said electrical elements are loaded into a one-piece contact receptacle 7 or more preferably in a contact receptacle 7 constituted by a wiring harness connector 5 and a contact casing 2 in order to facilitate the mounting and the locking of the electrical elements. In the latter case the electrical elements of the electric connector 9 are loaded into the wiring harness connector 5 through the rear opening 12 and the wiring harness connector 5 is inserted into a side opening 16 of the contact casing 2 perpendicularly to the plugging axis 13 by sliding guide grooves 14A, 14B of the wiring harness connector 5 onto corresponding guide rails 15A, 15B of the contact casing 2, as represented respectively on FIGS. 1 and 8.

On its external surface, the contact receptacle 7 comprises longitudinal rails 50 adapted to guide the contact receptacle 7 into the frame 4 as well as several transversal shoulders that are perpendicular to the plugging direction 13: two primary blocking shoulders 51A, 51B and a retention shoulder 53 are formed on the top 54 and on the bottom 56 surface of the contact receptacle 7, and a secondary blocking shoulder 52A, 52B is formed on each side surface 55 of the contact receptacle 7.

As shown in FIGS. 6 and 8, the primary 51A, 51B and the secondary blocking shoulders 52A, 52B have a respective rear flank 57, 58, which is able to block the tab of another element that slides along the frame in the plugging direction. These rear flanks 57, 58 are preferably perpendicular to the plugging axis 13. The primary blocking shoulders 51A, 51B have additionally a front flank 59 that is sloping, such that external elements which slide along the frame in the opposed plugging direction will not come into abutment with the front flank 59, but rather slide further along the front flank 59.

As can be taken from FIG. 7, the retention shoulder 53 has sloping front 60 and rear 61 flanks that allow an external element to slide on said retention shoulder 53 in both directions. The angle $\alpha$ of the front flank 60 is preferably smaller than the angle $\beta$ of the rear flank 61 with respect to the top 54 or bottom 56 surface from which the retention shoulder 53 is projecting.

The frame 4 comprises a rear section 17 and a front plug section 18. The rear section 17 is a surface with an aperture 19, which surface is perpendicular to the plugging axis 13 and parallel to the panel 6 into which the electric connector 9 is mounted. The front plug section 18 has the form of a rectangular sleeve that projects from the rear section 17 into the plugging direction. The aperture 19 of the rear section 17 thereby is also the rear aperture 19 of the front plug section 18. The front plug section 18 ends in the plugging direction with an ending section 42 that surrounds a front aperture 20, wherein the ending section 42 is at least partially sloping with respect to the plugging direction 13 in order to guide the frame 4 into the counterpart connector 10 during the plugging. The rear aperture 19 is used to insert the contact receptacle 7 into the frame 4 and the front aperture 20 enables the connection of the electrical elements of the connector 9 and its counter connector 10. Two openings 43A, 43B are provided in the front plug section 18 for the retention shoulders 53 of the contact receptacle 7 to be attainable once the contact receptacle 7 is mounted into the frame 4.

The front plug section 18 of the frame 4 has primary locking tabs 21A, 21B, 21C, 21D that are formed in pairs on two opposite bottom 23 and top 24 section, and secondary locking tabs 22A, 22B formed on two opposite side sections 25A, 25B.

As shown on FIG. 8, each primary locking tab 21A, 21B, 21C, 21D is respectively located in an opening 26 of the front plug section 18 that is slightly larger than the corresponding primary locking tab, and is composed in the plugging direction of a back section 30, a middle section 28, and a front section 29.

The middle section 28 is fastened to the frame 4 by means of two fixing clips 27A, 27B, such that the primary locking tabs 21A, 21B, 21C, 21D can slightly rotate around the axis build by said two fixing clips 27A, 27B. The thickness of the middle section 28 is smaller than the thickness of the frame 4, and the middle section 28 remains within the area defined by the external 31 and the internal 32 surface of the frame 4. In other words, it does not protrude from the frame 4 that surrounds the primary locking tabs 21A, 21B, 21C, 21D along the plugging axis 13.

The front 29 and back section 30 of the primary locking tabs 21A, 21B, 21C, 21D are the extensions of the middle section in the plugging direction and in the opposite plugging direction respectively. An external shoulder 33 is build on the external surface of the back section 30 and sticks out from the external surface 31 of the frame 4. The shoulder 33 has sloping flanks 34, 35 in the plugging direction as well as in the opposite direction for allowing the counterpart connector 10 to push the external shoulder 33 during the plugging and the unplugging of the connector 9 and its counterpart 10, in order to deflect and rotate the primary locking tabs 21A, 21B, 21C, 21D around the two fixing clips 27A, 27B.

An internal shoulder 36 is formed on the internal surface of the front section 29. This internal shoulder 36 has a sloping rear flank 37 and a front flank 38 that is preferably approximately perpendicular to the plugging axis 13. It is thereby necessary that the front flank 38 can come into abutment with another component without causing any rotation of the primary locking tab 21A, 21B, 21C, 21D.

The secondary locking tabs 22A, 22B, shown in FIGS. 2 and 6, are rigidly fixed to the frame 4 and extend longitudinally along the plugging direction up to the front aperture 20 of the frame 4. Each secondary locking tab 22A, 22B comprises a shoulder 39 having sloping flanks 40 and 41 on its external surface. Accordingly if the shoulder abuts upon another component in the plugging direction or in the opposite direction, the secondary locking tab 22A, 22B will deflect inwardly.

With reference to FIGS. 2 to 5, the frame 4 and its support panel 6 comprise further elements for centring the frame 4 during its mounting into the support panel 6, and for allowing movements of the mounted frame 4 in the X and Y directions, i.e. perpendicular to the plugging and mounting direction Z. The frame thereby comprises centring shoulders 62A, 62B, centring tongues 63A, 63B, L-shaped retaining tongues 64A, 64B, 64C, 64D, and retaining tabs 65A, 65B. The support panel 6 is a surface comprising an opening 66 for inserting the frame 4, teeth 67A, 67B, 67C, 67D, and apertures 68A, 68B, 68C, 68D.

Two centring shoulders 62A, 62B are formed on the bottom 23 and on the top 24 section and have a sloping surface in the mounting direction Z, such that during the mounting process the teeth 67B and 67D slide along the centring shoulders 62A, 62B and guide the frame 4 along the Y direction, as can be seen in FIG. 2B. Then the frame 4 can be moved transversally in order to latch the teeth 67A, 67B, 67C, 67D behind the retaining tongues 64A, 64B, 64C, 64D. It can be noted that other elements can be responsible for the centring of the frame 4 into the panel 6 like e.g. elastic elements inserted between said frame 4 and said panel 6.

A retaining shoulder 69A, 69B is formed on each retaining tab 65A, 65B and extends in the mounting direction Z. Therefore, the retaining tabs 65A, 65B, which are elastically deflectable, are at first deflected by the teeth 67B and 67D. Then the transversal movement of the frame places the retaining shoulder 69A, 69B in front of the apertures 68A and 68C, such that the teeth 67B and 67D spring back in their original non-deflected position and the retaining shoulders 69A, 69B come in the apertures 68A and 68C, see FIG. 2C.

The support panel 6 and the frame 4 are preferably two distinct elements in order to allow a parallel movement of the frame 4 relatively to the panel 6 for compensating positional tolerances into the X-Y plane, as can be seen in FIG. 3. The frame 4 can thus float and rotate into said X-Y plane.

The contact header 1 has a parallelepipedic shape and is rigidly fixed in the electronic device casing 3. The contact header 1 has a front opening 70 for receiving the electronic connector 9, a rear opening 71 for receiving the electrical elements of preferably an electronic device, a front section 72, and two apertures 73A, 73B on a bottom 74 and on a top 75 section. The front section 72 surrounds the front opening 70 and is funnel-shaped in order to ease the insertion of the electrical connector 9 during its plugging into the counterpart connector 10.

FIG. 7 shows a retaining tab 76 fixed on a rail 77 that can deflect in the Y direction. The contact header 1 altogether contains two retaining tabs 76 that are designed to latch behind the retention shoulders 53 of the contact receptacle 7.

In the following the operation of mounting the contact receptacle 7 into the frame 4 of the electrical connector 9 according to the first embodiment will be described with reference to FIG. 8.

Before plugging the electrical connector 9 in the counterpart connector 10, the contact receptacle 7 composed of the wiring harness connector 5 and the contact casing has to be mounted in the electrical connector 9. When inserting the contact receptacle 7 into the frame 4, the primary blocking shoulders 51A, 51B touch the internal shoulder 36 of the primary locking tabs 21A, 21B, 21C, 21D. By pushing further the contact receptacle 7, the rear flank 37 of each internal shoulder 36 slides along the front flank 59 of the primary blocking shoulders 51A, 51B, causing an outwards deflection of the front section 29 of the primary locking tabs 21A, 21B, 21C, 21D.

When the primary blocking shoulders 51A, 51B pass by the internal shoulder 36, the primary locking tabs 21A, 21B, 21C, 21D spring back to their initial position, in parallel to the front 24 or bottom 23 section on which the primary locking tab is formed. At this time, the front flank 38 of the internal shoulder 36 prevents from pulling back the contact receptacle 7. Indeed if the primary blocking shoulders 51A, 51B moves back, they abut against the front flank 38 of the internal shoulder 36. In the mounting direction, the contact receptacle 7 also comes into abutment with the frame 4. As a result, the contact receptacle 7 is blocked in an intermediate position in the frame 4.

In the following the operation of plugging the electrical connector 9 into the counterpart connector 10 according to the first embodiment will be described with reference to FIGS. 9 to 14.

The contact receptacle 7 is initially held in the intermediate position in the frame 4 by means of a first locking mechanism 78, see FIG. 8, consisting in the abutment of the primary blocking shoulders 51A, 51B against the internal shoulder 36 of the primary locking tabs 21A, 21B, 21C, 21D. The first contact between the electrical counterpart connector 10 and the electrical connector 9 occurs during the plugging between the funnel-shaped front section 72 and two different parts of the electrical connector 9 that are the chamfered ending section 42, see FIG. 2B, and the chamfered flank 40 of the shoulder 39 build on the secondary locking tabs 22A, 22B, see FIG. 9A.

Figure 10A:
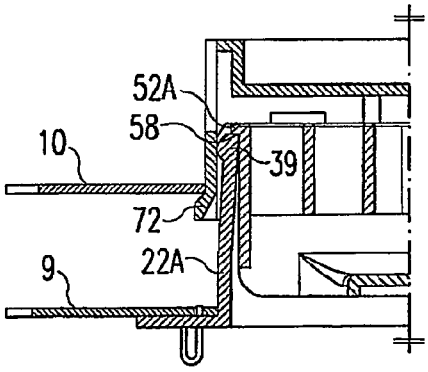
Figure 10B:
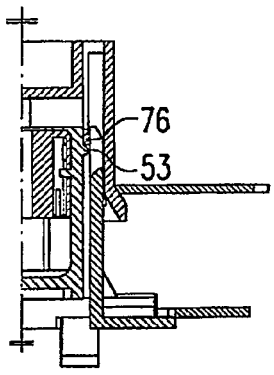
Figure 10C:
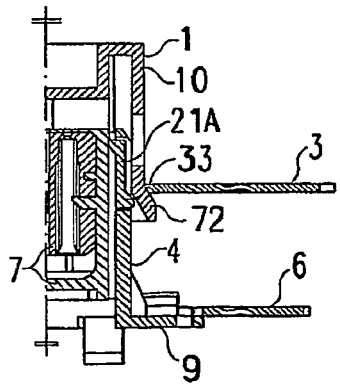

FIG. 10A to 10C show the first step of the insertion of the connector 9 into the counterpart 10. During this step, the shoulder 39 slides along the inner surface of the contact header 1 and particularly along its funnel-shaped front section 72. As a result, the secondary locking tabs 22A, 22B deflect inwardly and abut against the secondary blocking shoulders 52A, 52B of the contact receptacle 7. This constitutes a second locking mechanism 79, see FIG. 6, that prevents, as well as the first locking mechanism 78, the contact receptacle 7 from leaving its intermediate position in the frame 4.

In this step, the first locking mechanism 78 is still engaged and the external shoulder 33 of the primary locking tabs 21A, 21B, 21C, 21D touches for the first time the front section 72 of the electrical counterpart 10, see FIG. 10C. From FIG. 10B it can be seen that the retaining tab 76 of the electrical counterpart 10 comes into contact with the retention shoulder 53 of the electrical connector 9.

Figure 11A:
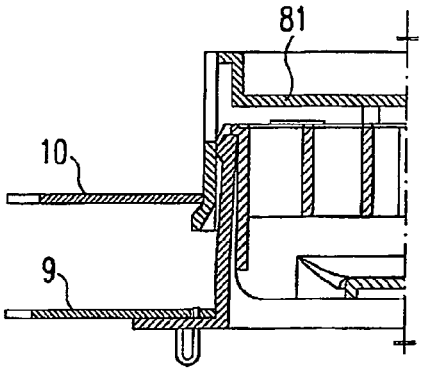
Figure 11B:
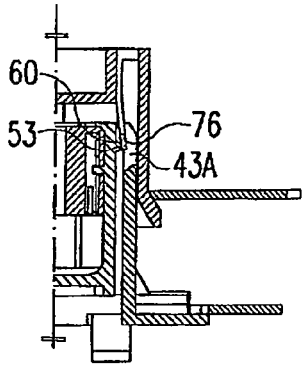
Figure 11C:
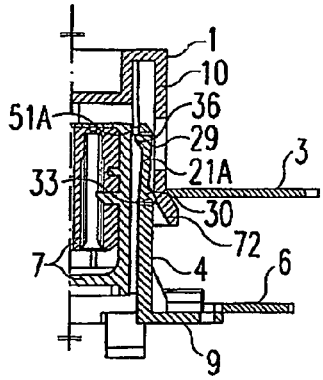

With reference to FIG. 11C, the first locking mechanism 78 is unlocked when the electrical connector 9 is further inserted deeper into the counterpart 10. Indeed, the external shoulder 33 is pushed inwardly by the sloping front section 72. This causes a rotation of the primary locking tabs 21A, 21B, 21C, 21D and a deflection of the front section 29 away from the contact receptacle 7. Consequently, the contact between the internal shoulder 36 of the primary locking tabs 21A, 21B, 21C, 21D and the primary blocking shoulder 51A, 51B is broken.

FIG. 11B shows that in the meantime the retaining tab 76 deflects outwardly into the opening 43A, 43B of the frame 4 as a result of its sliding along the sloping front flank 60 of the retention shoulder 53.

The electrical connector 9 and its counterpart 10 continue to engage until the contact receptacle 7 abuts against a mating surface 81 of the contact header 1 and until the electrical connection between the electrical elements of the connector 9 and its counterpart 10 is completed. The connectors 9, 10 are now mated.

Figure 12A:
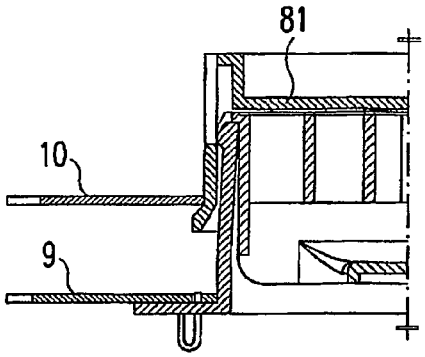
Figure 12B:
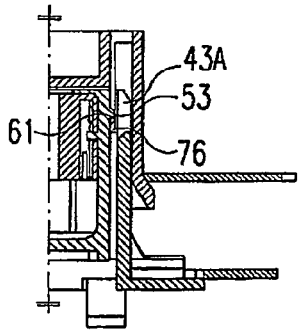
Figure 12C:
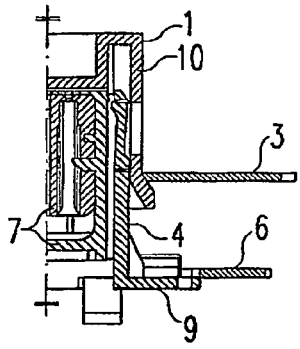

In this condition and as shown in FIG. 12B, the retaining tab 76 of the contact header 1 springs back from the opening 43A, 43B to its initial position along the contact receptacle 7. The contact header 1 is then locked to the contact receptacle 7 by, on the one hand, the abutment of the electrical connector 9 against the mating surface 81 of the contact header 1, and on the other hand, the abutment of the retaining tab 76 against the rear flank 61 of the retention shoulder 53. The latter abutment defines a third locking mechanism 80, see FIG. 7.

FIG. 13A shows the next step of the plugging of the electrical connector 9 into the counterpart connector 10, wherein the second locking mechanism 79 is released. When pushing the connector 9 further, the shoulder 39 gradually slides in an aperture 82 of the contact header 1, such that the secondary locking tabs 22A, 22B come back to their initial non-deflected position. Thus, the secondary blocking shoulders 52A, 52B of the contact receptacle 7 are not retained anymore by secondary locking tabs 22A, 22B and the contact receptacle 7 is released from its intermediate position into the frame 4. It has to be noted that the engagement of the third locking mechanism 80 and the release of the second locking mechanism 79 can occur simultaneously.

In FIG. 14C it can be seen that once the internal shoulder 36 has passed the primary blocking shoulder 51A, 51B, the external shoulder 33 springs into the aperture 73A, 73B of the contact header 1, such that the primary locking tabs 21A, 21B, 21C, 21D elastically revert to their initial state. The mated connectors 9, 10 are now in a plugged state.

A free space 83 is provided in the contact header 1, so that the contact receptacle 7 can be further inserted into said contact header 1 over a maximum length ΔL until the ending section 42 abuts against a rear surface 84 of the contact header 1 and/or until the front section 72 abuts against an element of the electrical connector 9. The assembly consisting of the plugged contact header 1 and contact receptacle 7 can therefore be moved along the plugging direction in order to compensate for positional tolerances in said direction.

A spring is inserted behind the contact receptacle 7 in the plugging direction, or Z axis, and is preferably located between a rear surface 44 of the contact receptacle 7 and a rear section 45 of the frame 4, see FIGS. 7 and 8.

When the contact receptacle 7 is in the intermediate position, the spring is compressed and exerts a force F1 on the contact receptacle 7, which force F1 is superior to the force F2 applied by an operator to mate the two connectors 9, 10:

$$F1=F2+X$$

Once the connectors 9, 10 are plugged, i.e. once the intermediate position of the contact receptacle 7 is unlocked, the operator can apply a force F3 to the counterpart connector 10 to compensate for positional tolerances in the plugging direction. This force F3 is given by following equation:

$$F3=F1+S.d$$

wherein S is the longitudinal displacement of the assembly contact header 1 and contact receptacle 7 with respect to the intermediate position, and d is the constant of the spring.

Accordingly, the mating force F2 and the force F3 applied for tolerance compensation are decoupled from each other and do not depend on each other.

In the following the operation of unplugging the electrical connector 9 and the counterpart connector 10 according to the first embodiment will be described.

Figure 9A:
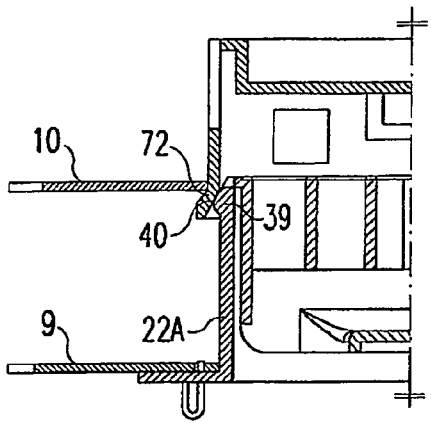
Figure 9B:
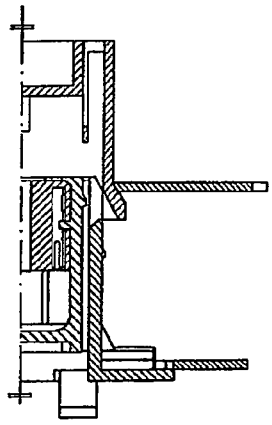
Figure 9C:
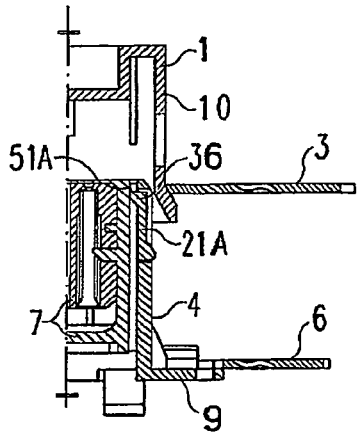

The plugging process is reversible and can be followed from FIG. 14 to FIG. 9. When pulling the plugged electrical connector 9 back in the opposite direction, the retaining tab 76 of the counterpart connector 10 abuts against the retention shoulder 53 and is maintained in this abutment position by the top 24 or bottom 23 section, see FIG. 14B. As a consequence, the contact receptacle 7 and the counterpart connector 10 remain mated and their electrical elements remain in electrical contact by means of the third locking mechanism.

With reference to FIG. 12B, the retaining tab 76 brings the contact receptacle 7 back to its intermediate position, where the contact receptacle 7 comes into abutment with the frame 4.

FIGS. 11B and 12B show that by pulling further the electrical connector out of the counterpart 10, the retaining tab 76 slides over the sloping rear flank 61 of the retention shoulder 53 into the opening 43A, 43B. The third locking mechanism 80 is therewith released, such that the contact receptacle 7 and the contact header 1 can be unmated. The two connectors 9, 10 are then separated, with the contact receptacle 7 being in the intermediate position.

To summarise, the electrical connector 9 and its counterpart 10 can be chronologically in the following different states during the plugging process:

- When the connector 9 is mounted, the contact receptacle 7 is inserted into the frame 4 in an intermediate position, which is maintained by a first 78 and/or a second locking mechanism 79. The connector 9 is then ready for plugging into the counterpart connector 10.
- The connectors 9, 10 are mated when their electrical elements are orderly connected and the electrical contact between them is established. In such a condition, the contact receptacle 7 can abandon the intermediate position.
- The connectors 9, 10 are plugged when the mated state is insensitive to further movements of one connector relatively to the other along the plugging direction. In the plugged state, the first 78 and the second 79 locking mechanisms are released to unlock the contact receptacle 7 from its intermediate position and the third locking mechanism 80 is engaged to ensure that the contact receptacle 7 reaches again the intermediate position during the unplugging process.

The three locking mechanisms that are involved in the mounting and plugging process are the following:

The first locking mechanism 78 locks the contact receptacle 7 into the intermediate position. This mechanism 78 is preferably engaged before the assembly and can be released as soon as the second locking mechanism 79 maintains the intermediate position. This locking involves the rotatable primary locking tabs 21A, 12B, 21C, 21D of the frame 4, the primary blocking shoulders 51A, 51B of the contact receptacle 7, and the front section 72 of the counterpart 10.

The second locking mechanism 79 is used to lock the contact receptacle 7 in its intermediate position during the plugging process. It is engaged when the first mechanism 78 still locks and released as soon as the connectors 9, 10 are mated to enable a positional compensation in the plugging direction. This mechanism involves the secondary locking tabs 22A, 22B of the frame 4, the secondary blocking shoulders 52A, 52B of the contact receptacle 7, as well as the front section 72 of the counterpart 10.

The third locking mechanism 80 locks the contact receptacle 7 to the counterpart connector 10 and can be engaged as soon as the connectors 9, 10 are mated and/or as soon as the contact receptacle 7 leaves its intermediate position. This allows additional movements of the counterpart connector 10 in the plugging direction by simultaneously maintaining the electrical connection. This third mechanism 80 involves the retaining tab 76 of the counterpart connector 10, the retention shoulder 53 of the contact receptacle 7, and the opening 43A, 43B of the frame 4.

In the following a second embodiment of the connection system according to the present invention will be described with reference to FIGS. 15 to 20. The description particularly focuses on the structural and functional differences to the first embodiment. For identical or similar features, reference is made to the description of the first embodiment.

In FIG. 15 is shown an exploded representation of a connection system 8' according to second embodiment of the invention. The connection system 8' consists in an electrical connector 9' and an electrical counterpart connector 10' to be connected together along the plugging axis 13. The second embodiment 8' differentiates from the first embodiment 8 in that the counterpart connector 10' is plugged into the connector 9'. The electrical connector 9' comprises a contact receptacle 7' placed in a frame 4' that is mounted into the support panel 6. The electrical counterpart connector 10' comprising a contact header 1' rigidly fixed to the casing 3'. The contact receptacle 7' consists of one or several pieces, wherein it is preferably composed of a contact casing 2' and of a wiring harness connector 5' that is inserted into the contact casing 2' perpendicularly to the plugging axis 13 by sliding the guide grooves 14A, 14B along the rails 15A, 15B of the contact casing 2'.

Three kinds of shoulders involved in three different locking mechanisms are formed on the contact receptacle 7' perpendicularly to the plugging axis 13: primary blocking shoulders 100A, 100B, secondary blocking shoulders 101, and retention shoulders 102A, 102B.

With reference to FIGS. 15 and 18, two primary blocking shoulders 100A, 100B are formed on each side surface 55 of the contact receptacle 7'. In case the contact receptacle 7' is build around a wiring harness connector 5' laterally inserted into a contact casing 2', the two primary blocking shoulders 100A, 100B are preferably formed on the side surface 55 of the contact casing 2' and the harness connector 5' respectively.

The primary blocking shoulders 100A, 100B have a sloping front flank 103 and a rear flank 104 that is adapted to serve as an abutment. The rear flank 104 is preferably perpendicular to the side surface 55 of the contact receptacle 7'.

FIGS. 15 and 19 show the secondary blocking shoulder 101 that is formed on the top 54 and on the bottom 56 surface of the contact receptacle 7'. Like the first blocking shoulder 100A, 100B, said secondary blocking shoulder 101 comprises a sloping front flank 105 and a rear flank 106 preferably perpendicular to the surface on which it is build in order to abut against an external element.

The retention shoulders 102A, 102B, shown in FIGS. 15 and 20, are formed on the top 54 and on the bottom 56 surface of the contact receptacle 7' and have sloping front 107 and rear 108 flanks, such that an external element can slide over the retention shoulder 102A, 102B in both directions. With reference to the surface on which the retention shoulders 102A, 102B are build, the angle $\alpha'$ of the front flank 107 is preferably smaller than the angle $\beta$ of the rear flank 108.

The frame 4' comprises a rear section 17 similar to that of the first embodiment and a front plug section 18'. The front plug section 18' has a front aperture 20 and an ending section 42' being funnel-shaped to ease the plugging of the counterpart connector 10' into the frame 4' of the connector 9'.

As shown in FIGS. 15 and 18, primary locking tabs 109A, 109B are formed laterally on the side sections 25A, 25B of the frame 4'. They comprise on their inner surface 114 a central shoulder 111 and two lateral shoulders 127, the central shoulder 111 having a sloping rear flank 113 and an abutment front flank 112, and the two lateral shoulders 127 having two sloping front 128 and rear 129 flanks. The primary locking tabs 109A, 109B are preferably rectangular and rigidly fixed to a fixation section 110 of the frame 4', such that the primary locking tabs 109A, 109B can be deflected by pushing the shoulder 111 outwardly.

With reference to FIGS. 15 and 19, the bottom 23 and the top section 24 of the frame 4' comprise a secondary locking tab 115A, 115B being parallel to said bottom 23 or top section 24. The secondary locking tabs 115A, 115B are preferably rectangular and have three succeeding sections in the plugging direction: a back section 117, a middle section 118, and a front section 119. The two sides of the middle section 118 are fixed to the frame 4' by means of a fixing clip 116A, 116B, such that the secondary locking tab 115A, 115B can at least slightly rotate around its middle section, i.e. around the axis built by the two fixing clips 116A, 116B.

Two shoulders are formed perpendicularly to the plugging axis 13 on an inner surface 126 of the secondary locking tab 115A, 115B. A first shoulder 124 is build on the front section 119 and has sloping front 125 and rear 123 flanks. A second shoulder 120 formed on the back section 117 presents a sloping rear 121 flank and an abutment front flank 122 that is preferably perpendicular to the inner surface 120. On the one hand, the sliding of an external element along the inner surface of the frame 4' and over the three sloping flanks of the first 124 and second shoulder 120 causes an outwards deflection of the respective shoulder and therefor a rotation of the secondary locking tab 115A, 115B. On the other hand, an external element striking on the front flank 122 will abut against said front flank 122 and will no cause any rotation of the secondary locking tab 115A, 115B.

The contact header 1' of the counterpart connector 10' has essentially a rectangular shape with a bottom 74 and a top 75 section, and two side sections 130. The electrical elements of the connector 9' are inserted through a front opening 70 up to a transversal mating surface of the contact header 1', where the connector system is mated. The contact header 1' ends in the plugging direction with an ending section 133, which inner surface is funnel-shaped in order to guide the contact receptacle 7' during the plugging.

FIGS. 15 and 18 show that the side sections 130 of the contact header 1' comprises a first aperture 136. This first aperture 136 consists of a central opening 137 that is tangent to the front opening 1 of the contact header 1' and of two lateral openings 138A, 138B. A second aperture 139 is formed longitudinally on the bottom 74 and the top 75 section of the contact header 1', see FIG. 19.

As shown in FIG. 20, two retention tabs 131A, 131B comprising an aperture 134 are built in each bottom 74 and top 75 section and extend from a fixation side 132, which is rigidly fixed to the corresponding bottom 74 or top 75 section, into the plugging direction. The other sides of the retention tab 131A, 131B are free, such that it can deflect inwardly or outwardly. It has to be further noted that the ending section 133 of the contact header 1' has preferably a constant thickness except in an area referred to as retention ending section 135, which is the extension of the aperture 134 in parallel to the plugging axis 13. This retention ending section 135 is less thick than the remaining ending section 133.

In the following the operation of mounting the contact receptacle 7' into the frame 4' of the electrical connector 9' according to the second embodiment will be described with reference to FIG. 18.

When mounting the contact receptacle 7' into the frame 4', the rigid primary blocking shoulders 100A, 100B hit on the central shoulder 111 of the primary locking tabs 109A, 109B. Inserting further the contact receptacle 7' causes said central shoulder 111 to slide over the primary blocking shoulders 100A, 100B and to latch behind the rear flank 104, such that the contact receptacle 7' is blocked in an intermediate position in the frame 4'. This locking defines a first locking mechanism 78'.

In the following the operation of plugging the electrical connector 9' and the counterpart connector 10' according to the second embodiment of the invention will be described with reference to FIG. 21 to 26.

Figure 21A:
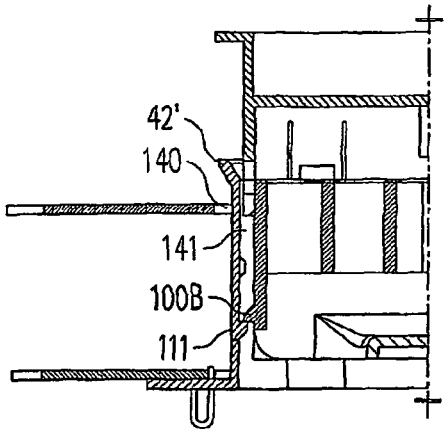
Figure 21B:
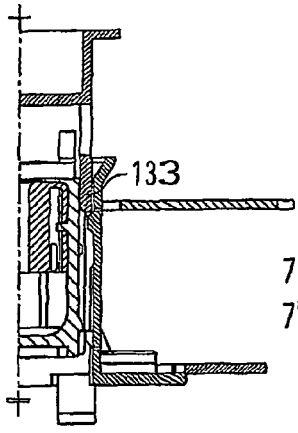
Figure 21C:
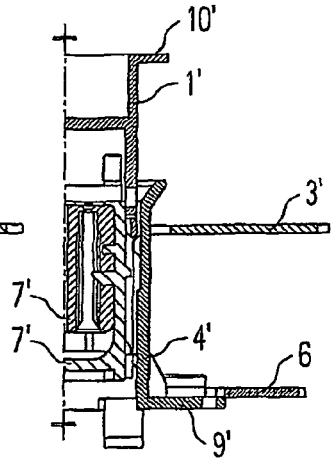
Figure 22A:
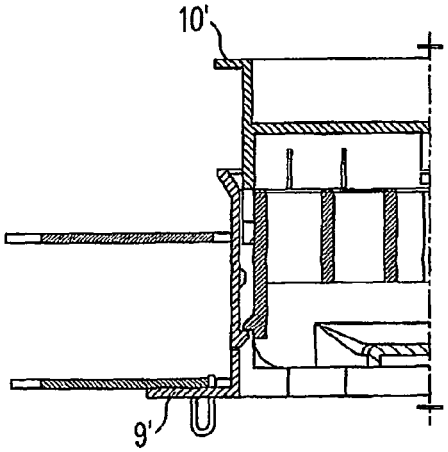
Figure 22B:
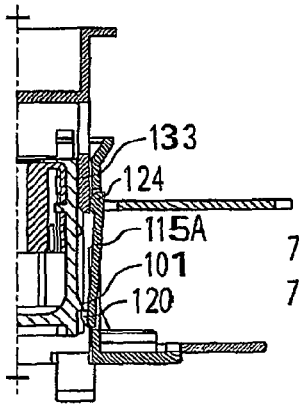
Figure 22C:
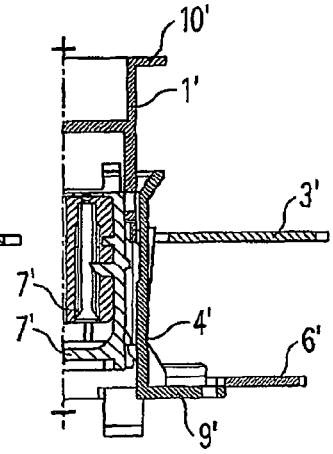

In FIG. 21, the first locking mechanism 78' is engaged, i.e. the contact receptacle 7' is in the intermediate position into the frame 4'. When plugging the connector system 8', the ending section 42' of the frame 4' is inserted into a slot 140 between the contact header 1' and the casing 3', and the ending section 133 of the contact header 1' is inserted into a slot 141 between the frame 4' and the contact receptacle 7'.

When inserting further the contact receptacle 7' into the contact header 1', the ending section 133 of the bottom 74 and the top 75 section of the contact header 1' strikes on the first shoulder 124 of the secondary locking tabs 115A, 115B. This causes an outwards deflection of said first shoulder 124 and a rotation of the secondary locking tabs 115A, 115B. Consequently, the second shoulder 120 is deflected inwardly towards the contact receptacle 7' and is placed directly behind the secondary blocking shoulders 101, which prevents the contact receptacle 7' from leaving its intermediate position. This locking mechanism is referred to as a second locking mechanism 79'.

Figure 23A:
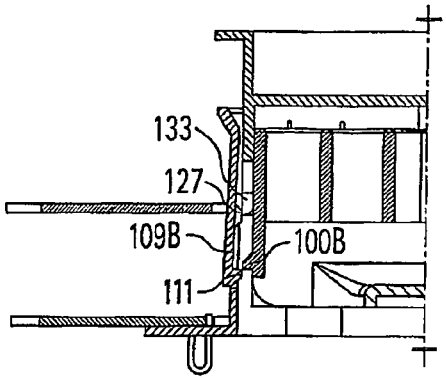
Figure 23B:
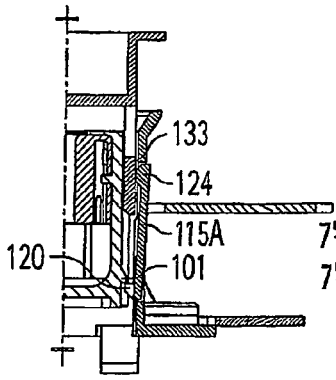

In the condition of FIG. 23, the primary locking tabs 109A, 109B have been deflected outwardly as a consequence of the contact between the ending section 133 of the contact header 1' and the lateral shoulders 127 of the frame 4'. The central shoulder 111 leaves its latching position behind the primary blocking shoulder 100A, 100B and the first locking mechanism 78' is released. The contact receptacle 7' is nevertheless maintained in its intermediate position by the second locking mechanism 79'.

Figure 23C:
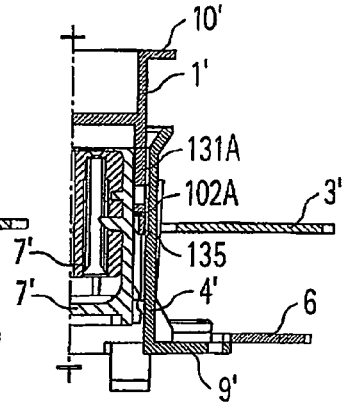
Figure 24A:
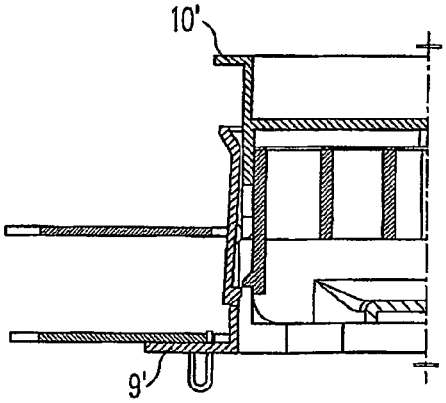
Figure 24B:
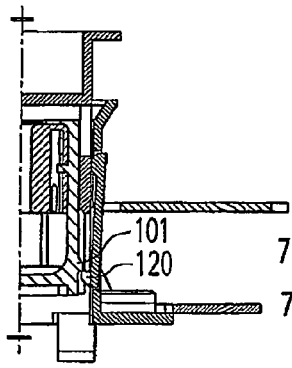
Figure 24C:
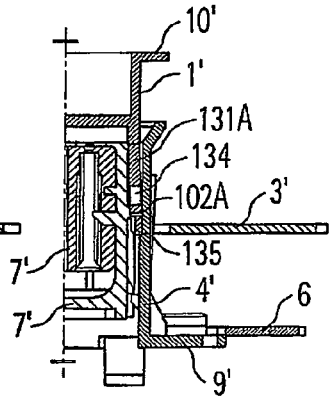

The retention ending section 125 of the contact header 1' having passed the retention shoulder 102A, 102B of the contact receptacle 7', the retention tab 131A, 131B slides over said retention shoulder 102A, 102B, see FIG. 23C, 24C. Next when the aperture 134 comes over said retention shoulder 102A, 102B, the retention tab 131A, 131B springs back to its normal non-deflected position in the slot 141, see FIG. 25C. Then, pushing further the connector 9' into the counterpart 10' causes a third locking mechanism 80', consisting in the retention shoulder 102A, 102B being blocked in the aperture 134, to be engaged, see FIG. 26C.

In the step shown in FIG. 25, the connectors 9', 10' are electronically matted together, such that it is no more necessary to held the intermediate position of the contact receptacle 7'. Thus in the following step shown in FIG. 26B, the shoulder 124 comes into the aperture 139 and the secondary locking tab 115, 115B rotates back to its initial position in parallel to the top 24 or bottom 23 section of the frame 4'. Consequently, the shoulder 120 no longer abuts against the secondary blocking shoulder 101 and the secondary locking mechanism 79' is released.

In its state of FIG. 26, the connector system 8' is plugged and also insensitive to further movements of the two connectors 9', 10' along the plugging direction over a maximum length $\Delta L'$.

The plugging being reversible, the unplugging operation simply consists in the corresponding reverse steps. Particularly, the third locking mechanism 80' carries the contact receptacle 7' to its intermediate position before the second 79' and the first locking mechanism 78' maintain this intermediate position after the connectors have been unmated.

FIGS. 27 and 28 show a connector system 8" according to a third embodiment of the invention. The connector system 8" comprises an electrical connector 9" and a counterpart connector 10". The electrical connector 9" comprises principally a contact receptacle 7", a frame 4", and a support panel 6" onto which is mounted the frame 4". The contact receptacle 7" is inserted into the frame 4" and is designed to plug into a contact header 1" of the counterpart connector 10".

The plugging and unplugging processes comprise the same steps as for the preceding embodiments allowing to compensate for positional tolerances along the plugging axis. Particularly the connector system 8" also comprises locking means for locking the contact receptacle 7" in an intermediate position and locking means for locking the contact receptacle 7" to the contact header 1" of the counterpart connector 10".

Centring tabs 150A to 150E are formed two by two on the sides of a front plug section 18" of the frame 4" in the direction of a rear section 17" of said frame 4". A free space 151 is comprised between the ending of a centring tab 150A to 150E and the rear section 17".

During the insertion of the frame 4" into an opening 152 of the support panel 6", the centring tabs 150A to 150E deflect inwardly. When the rear section 17" hits the support panel 6", the centring tabs 150A to 150E take their initial position back such that the support panel 6" catches in the free space 151. The frame 4" can therefore float into the support panel 6" perpendicularly to the plugging direction.

The invention claimed is:

1. A method for connecting a contact receptacle of a connector and a contact header of a counterpart connector, comprising the steps of:

locking the contact receptacle in an intermediate position into a frame of the connector, mating the contact header to the contact receptacle, releasing the contact receptacle from its intermediate position into the frame after only a partial amount of the mating of the contact header to the contact receptacle.

2. The method according to claim 1, wherein the connecting of the connector and the counterpart connector locks the contact receptacle in the intermediate position by a second locking mechanism.

3. The method according to claim 1, wherein the contact receptacle is locked to another portion of the counterpart connector after the contact header has been mated to the contact receptacle.

4. The method according to claim 1, wherein after the contact header and contact receptacle are mated they are moved together relative to the frame along a plugging axis.

5. The method according to claim 1, wherein the contact receptacle is locked in the intermediate position before the connector and the counterpart connector are plugged together.

6. The method according to claim 5, wherein insertion of the contact receptacle into the frame locks the contact receptacle in the intermediate position.

7. The method according to claim 1, wherein the frame is installed into a support panel in which the frame floats.

8. A connection system for connecting a contact receptacle of a connector and a contact header of a counterpart connector, comprising:

first locking means for maintaining the contact receptacle in an intermediate position into a frame of the connector, and unlocking means for releasing the contact receptacle from its intermediate position after partial insertion of the connector into the counterpart connector, wherein the contact receptacle is released from the intermediate position with the frame before reaching a final insertion position of the connector into the counterpart connector.

9. The connection system according to claim 8, wherein the first locking means is adapted to lock the contact receptacle in the intermediate position during plugging of the connector and the counterpart connector.

10. The connection system according to claim 9, comprising second locking means for locking the contact receptacle to the counterpart connector subsequently after the contact header has been mated to the contact receptacle.

11. The connection system according to claim 8, comprising second locking means adapted to lock the contact receptacle to the counterpart connector subsequently after the contact header has been fully mated to the contact receptacle.

12. The connection system according to claim 8, comprising a free space for the contact header and the contact receptacle to be moved within the frame along a plugging axis after the contact header and the contact receptacle have been mated.

13. The connection system according to claim 8, comprising additional locking means for maintaining the intermediate position of the contact receptacle with the frame after unlocking of the first locking means and before the connector and the counterpart connector are fully mated.

14. The connection system according to claim 8, comprising a support panel for installing the frame, the frame being sized and shaped to move in a plane parallel to and along the support panel.

15. A connector for plugging in a counterpart connector, the connector comprising:

a frame, and a contact receptacle that is movable into the frame, wherein first locking means of the frame and first locking means of the contact receptacle are designed to lock the contact receptacle in an intermediate position into the frame, and second locking means of the contact receptacle are designed to lock the contact receptacle to the counterpart connector, wherein the first locking means are designed to be unlocked after the second locking means locks the contact receptacle to the counterpart connector, and wherein a third locking means is designed to subsequently lock the frame with the counterpart connector by further insertion of the frame into the counterpart connector after the contact receptacle is fully connected with the counterpart connector.

16. A counterpart connector which is sized and shaped to have the connector according to claim 15 plugged into the counterpart connector, the counterpart connector having a contact header, which comprises means for unlocking the contact receptacle of the connector from the intermediate position with the frame, and locking means for locking of the contact header with the contact receptacle of the connector.

17. An electronic device comprising at least one counterpart connector according to claim 16.

* * * * *